US011130308B2

(12) United States Patent
Suzuki

(10) Patent No.: US 11,130,308 B2
(45) Date of Patent: Sep. 28, 2021

(54) BINDING APPARATUS AND IMAGE FORMING SYSTEM INCLUDING SAME

(71) Applicant: Nobuyoshi Suzuki, Tokyo (JP)

(72) Inventor: Nobuyoshi Suzuki, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/890,090

(22) Filed: Jun. 2, 2020

(65) Prior Publication Data

US 2020/0391472 A1 Dec. 17, 2020

(30) Foreign Application Priority Data

Jun. 17, 2019 (JP) ..... JP2019-112201

(51) Int. Cl.
*B31F 5/02* (2006.01)
*B65H 37/04* (2006.01)
*B31F 1/07* (2006.01)

(52) U.S. Cl.
CPC ..... *B31F 5/02* (2013.01); *B31F 1/07* (2013.01); *B65H 37/04* (2013.01); *B31F 2201/0754* (2019.01); *B31F 2201/0779* (2013.01); *B65H 2301/43828* (2013.01); *B65H 2301/51616* (2013.01); *G03G 2215/00852* (2013.01)

(58) Field of Classification Search
None
See application file for complete search history.

(56) References Cited

U.S. PATENT DOCUMENTS 7,950,647 B2 * 5/2011 Iguchi ..... B26D 5/08 270/58.07
8,899,568 B2 * 12/2014 Matsushita ..... G03G 15/6544 270/58.08
8,905,395 B2 * 12/2014 Suzuki ..... B65H 31/34 270/58.12
8,915,490 B2 * 12/2014 Izumichi ..... B65H 45/18 270/32
9,090,051 B2 * 7/2015 Takahashi ..... B31F 5/02
9,440,478 B2 * 9/2016 Takahashi ..... B31F 1/07
(Continued)

FOREIGN PATENT DOCUMENTS

JP 2014-177344 9/2014
JP 2017-213787 12/2017

*Primary Examiner* — Leslie A Nicholson, III
(74) *Attorney, Agent, or Firm* — Harness, Dickey & Pierce, P.L.C.

(57) ABSTRACT

A binding apparatus includes a pair of pressing members to sandwich and press a sheet bundle to bind the sheet bundle, a rotator to rotate to periodically separate and contact the pressing members with each other, a detector to detect whether the rotator is between a first position at which the pressing members are separated from each other and a second position downstream from the first position in a forward rotation direction of the rotator, and control circuitry. The second position is upstream in the forward rotation direction from a peak position at which a pressing force between the pressing members is maximum. The control circuitry is configured to rotate the rotator in a reverse direction to the forward rotation direction to move the rotator to the first position when the detector detects that the rotator is between the first position and the second position in the forward rotation direction.

6 Claims, 28 Drawing Sheets

(56) References Cited

U.S. PATENT DOCUMENTS

| | | | |
|---|---|---|---|
| 9,568,880 | B2 * | 2/2017 | Yamazaki ..... B42C 1/00 |
| 2013/0154178 | A1 | 6/2013 | Suzuki et al. |
| 2013/0264762 | A1 | 10/2013 | Matsushita et al. |
| 2013/0270762 | A1 | 10/2013 | Saito et al. |
| 2013/0300050 | A1 | 11/2013 | Suzuki et al. |
| 2014/0138896 | A1 | 5/2014 | Yoshida et al. |
| 2014/0151951 | A1 | 6/2014 | Shibasaki et al. |
| 2014/0219747 | A1 | 8/2014 | Takahashi et al. |
| 2015/0003938 | A1 | 1/2015 | Morinaga et al. |
| 2015/0028540 | A1 | 1/2015 | Shibasaki et al. |
| 2015/0030414 | A1 | 1/2015 | Takahashi et al. |
| 2015/0076759 | A1 | 3/2015 | Kosuge et al. |
| 2015/0091246 | A1 | 4/2015 | Yoshida et al. |
| 2015/0360899 | A1 | 12/2015 | Takahashi et al. |
| 2016/0340144 | A1 | 11/2016 | Sakano et al. |
| 2016/0340145 | A1 | 11/2016 | Kunieda et al. |
| 2016/0360053 | A1 | 12/2016 | Suzuki et al. |
| 2017/0174465 | A1 | 6/2017 | Morinaga et al. |
| 2017/0217239 | A1 | 8/2017 | Suzuki et al. |
| 2017/0305706 | A1 | 10/2017 | Takahashi et al. |
| 2018/0259895 | A1 | 9/2018 | Shibasaki et al. |

* cited by examiner

FIG. 30

| PRESSING POSITION | HOME POSITION | | APPROACH-ING | PRESSING | | | | | | | RETREAT-ING | HOME POSITION | |
|---|---|---|---|---|---|---|---|---|---|---|---|---|---|
| PRESSING STATE | | | | CONTACT | PRESSURE INCREAS-ING | PRESSURE INCREAS-ING | PRESSURE INCREAS-ING | PEAK | PRESSURE DECREAS-ING | CONTACT | | | |
| TRANSITION IN FIGS. 29A TO 29F | A | A | A→B | B | B→C | C | C→D | D | D→E | E | E→F | F | F |
| HP SENSOR | ON | ON | OFF | OFF | OFF | OFF | OFF | OFF | OFF | OFF | OFF | ON | ON |
| CRANK POSITION SENSOR | OFF | ON | ON | ON | ON | OFF | OFF | OFF | OFF | OFF | OFF | OFF | ON |
| CRANK ROTATION DIRECTION AT INITIAL OPERATION | STOP | STOP | CCW | CCW | CCW | CW | CW | CW | CW | CW | CW | STOP | STOP |

BINDING APPARATUS AND IMAGE FORMING SYSTEM INCLUDING SAME

CROSS-REFERENCE TO RELATED APPLICATION

This patent application is based on and claims priority pursuant to 35 U.S.C. § 119(a) to Japanese Patent Application No. 2019-112201, filed on Jun. 17, 2019, in the Japan Patent Office, the entire disclosure of which is hereby incorporated by reference herein.

BACKGROUND

Technical Field

This disclosure relates to a binding apparatus and an image forming system including the binding apparatus.

Related Art

Sheets on which images have been formed by an image forming apparatus can be bound without metal staples (i.e., stapleless binding) instead of stapling with metal staples. Stapleless binding is performed by a pair of upper and lower pressing members (toothlike portions) disposed opposite to each other, which forms a binding opening. The pair of pressing members sandwiches and presses a sheet bundle in the thickness direction of the sheets, that is, the vertical direction, so that the fibers of the sheets are entangled with each other, thereby binding the sheet bundle.

SUMMARY

An embodiment of this disclosure provides a binding apparatus to bind a sheet bundle. The binding apparatus includes a pair of pressing members to sandwich and press a sheet bundle to bind the sheet bundle, a rotator to rotate to periodically separate and contact the pressing members with each other, a detector to detect whether the rotator is between a first position at which the pressing members are separated from each other and a second position downstream from the first position in a forward rotation direction of the rotator, and control circuitry. The second position is upstream in the forward rotation direction from a peak position at which a pressing force between the pressing members is maximum. The control circuitry is configured to rotate the rotator in a reverse direction to the forward rotation direction to move the rotator to the first position when the detector detects that the rotator is between the first position and the second position in the forward rotation direction.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 30 is a table illustrating a relation among a state transition of the stapleless binding unit, detection signals, and rotation of a crank in FIGS. 29A to 29F;

Figure 1:
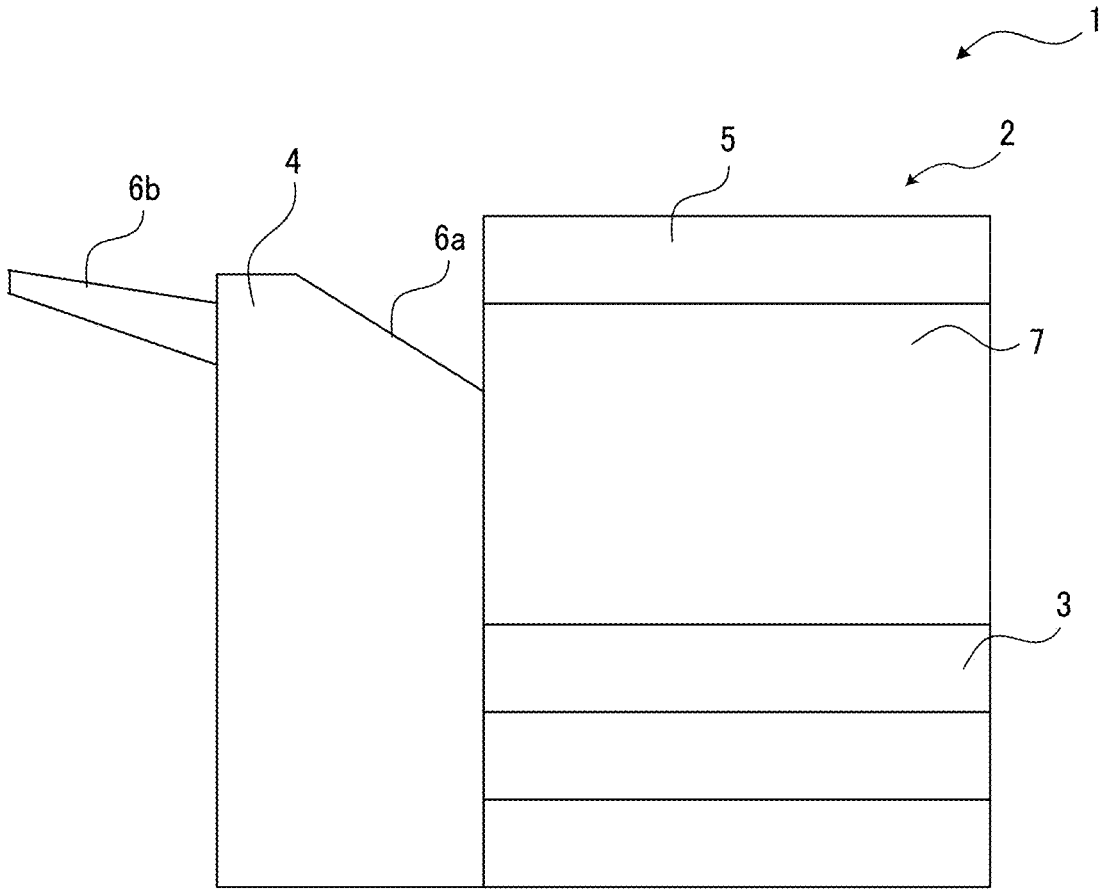
FIG. 1 is a schematic view illustrating a general arrangement of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Referring now to the drawings, wherein like reference numerals designate identical or corresponding parts throughout the several views thereof, embodiments of this disclosure are described. As used herein, the singular forms "a," "an," and "the" are intended to include the plural forms as well, unless the context clearly indicates otherwise.

A description is given of a binding apparatus and the image forming system according to the present embodiment. In the following, descriptions are given of two embodiments and prevention of the occurrence of "idle striking" in an initial operation of a stapleless binding unit. Here, the "initial operation" signifies an operation for moving components to home positions (reference positions), performed upon power on of the binding apparatus or in preparation for binding operation.

First Embodiment

With reference to FIG. 1, a description is given of an image forming system 1 according to an embodiment of the present disclosure. The image forming system 1 is a multi-function peripheral (MFP) having capabilities of image capture, image formation, communication, and the like and used as a printer, a facsimile machine, a scanner, and a copier. The image forming system 1 includes an image forming apparatus 2 and a binding apparatus 4. The image forming apparatus 2 includes a sheet feeder 3, a document reader 5, and an image forming unit 7. The image forming apparatus 2 can be without the document reader 5.

The image forming apparatus 2 generates drawing data of cyan, magenta, yellow, and key plate (CMYK) based on input image data and forms an image on a sheet fed from the sheet feeder 3 based on the generated drawing data.

Examples of the image forming apparatus 2 according to present embodiment include an electrophotographic image forming apparatus and an inkjet image forming apparatus. The sheet on which the image is formed by the image forming apparatus 2 is conveyed to the binding apparatus 4 or is ejected to an output tray 6*a* and sequentially stacked. The sheet feeder 3 supplies the sheet to the image forming unit 7.

The binding apparatus 4 executes a binding process to bind a plurality of image-formed sheets conveyed from the image forming apparatus 2. The binding apparatus 4 according to the present embodiment includes a staple binding unit that performs stapling with a metal staple (staple binding) and a stapleless binding unit that performs stapling without a metal staple (stapleless stapling or stapleless binding). The sheet bundle bound by the binding apparatus 4 is ejected to an output tray 6*b* and sequentially stacked.

The document reader 5 includes a linear image sensor in which a plurality of photodiodes are arranged in a line, and light-receiving elements such as a charge-coupled device (CCD) and a complementary metal oxide semiconductor (CMOS) image sensor are arranged in parallel to the photodiodes. The document reader 5 reads the document with the linear image sensor and converts the contacts thereof into electronic form. The document reader 5 can be provided with an automatic document feeder (ADF) to automatically feed a document to be read and configured to read the document fed therefrom.

Figure 2:
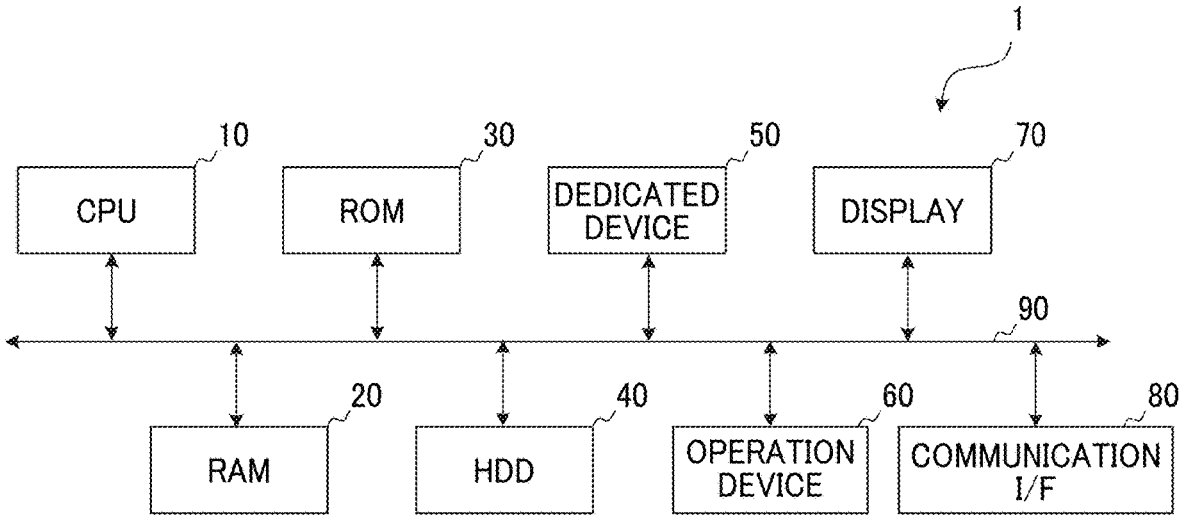
FIG. 2 is a schematic block diagram illustrating a hardware configuration of an image forming apparatus according to an embodiment.

Next, a description is given below of a hardware configuration of the image forming apparatus 2 according to the present embodiment with reference to FIG. 2. FIG. 2 is a schematic block diagram illustrating the hardware configuration of the image forming apparatus 2 according to the present embodiment.

As illustrated in FIG. 2, the image forming apparatus 2 includes a central processing unit (CPU) 10, a random access memory (RAM) 20, a read only memory (ROM) 30, a hard disk drive (HDD) 40, a dedicated device 50, an operation device 60, a display 70, and a communication interface (I/F) 80, which are connected to each other via a bus 90.

The CPU 10 is a computation device and controls actions of the entire image forming apparatus 2. The RAM 20 is a volatile storage medium that allows data to be read and written at high speed. The CPU 10 uses the RAM 20 as a work area for data processing. The ROM 30 is a non-volatile storage medium and stores programs such as firmware.

The HDD 40 is a data readable/writable non-volatile storage medium in which various kinds of data such as image data, an operating system (OS), various kinds of control programs, or application programs are stored. The dedicated device 50 is hardware for implementing a dedicated function in the image forming system 1.

The operation device 60 is a user interface for inputting information to the image forming apparatus 2, and is implemented by an input device such as a keyboard, a mouse, an input button, and a touch panel. The display 70 is a visual user interface for confirming the status of the image forming apparatus 2. The display 70 is, for example, a liquid crystal display (LCD) or an output device such as a light emitting diode (LED).

The communication I/F 80 is an interface for the image forming apparatus 2 to communicate with another apparatus. The communication I/F 80 is an interface that complies with Ethernet (registered trademark), universal serial bus (USB), Bluetooth (registered trademark), Wireless Fidelity (Wi-Fi), FeliCa (registered trademark), peripheral component interconnect express (PCIe), or standards of the institute of electrical and electronics engineers (IEEE).

In such a hardware structure, the program stored in a memory, such as the ROM 30 and the HDD 40, is loaded in the RAM 20, and the CPU 10 executes calculation according to the program loaded in the RAM 20, thereby implementing a software controller. The software controller thus implemented and the hardware, in combination, construct functional blocks for the capabilities of the image forming apparatus 2.

Next, descriptions are given below of a functional configuration of the image forming apparatus 2 according to the present embodiment with reference to FIG. 3.

Figure 3:
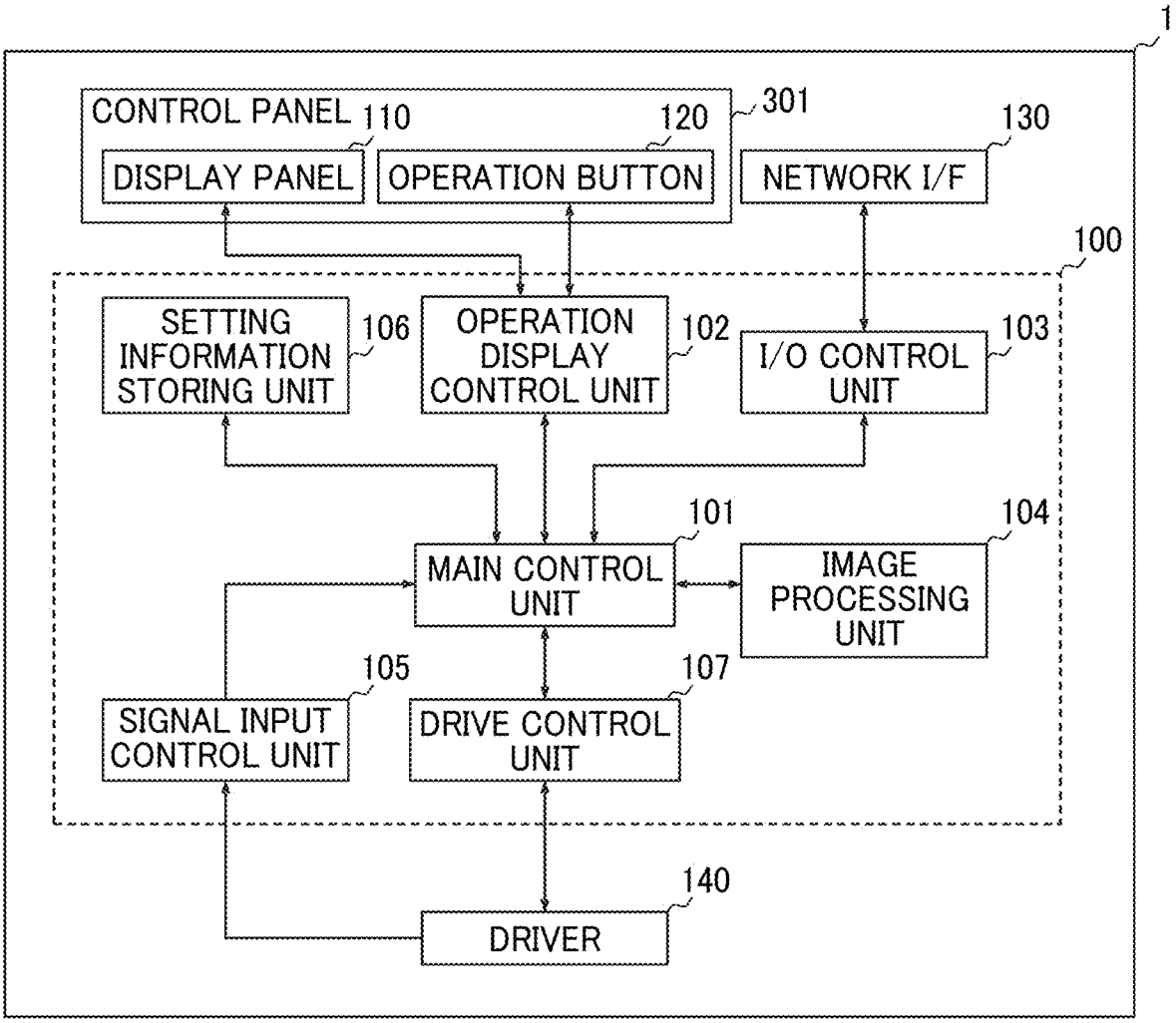
FIG. 3 is a schematic block diagram illustrating a functional configuration of the image forming apparatus illustrated in FIG. 2.

As illustrated in FIG. 3, the image forming apparatus 2 includes a controller 100, a display panel 110, an operation button 120, a network interface (I/F) 130, and a driver 140. The controller 100 further includes a main control unit 101, an operation display control unit 102, an input and output (I/O) control unit 103, an image processing unit 104, a signal input control unit 105, a setting information storing unit 106, and a drive control unit 107.

The display panel 110 is an output interface to visually display the state of the image forming system 1 as well as an input interface as a touch panel for a user to directly operate the image forming system 1 or input information into the image forming system 1. That is, the display panel 110 has a capability to display an image to accept a manual operation by the user. The display panel 110 is implemented by the operation device 60 and the display 70 illustrated in FIG. 2.

The operation button 120 is an input interface for the user to directly operate the image forming system 1 or input information to the image forming system 1. The operation button 120 is implemented by the operation device 60 illustrated in FIG. 2.

The user can input setting information such as sheet information by operating the display panel 110 and the operation button 120.

The network I/F 130 is an interface for communicating with an information processing apparatus such as a personal computer (PC) operated by the user. The network I/F 130 is implemented by the communication I/F 80 illustrated in FIG. 2. The image forming apparatus 2 receives various kinds of information including setting information, such as sheet information, image data, and print jobs from the above-mentioned information processing apparatus via the network I/F 130.

The driver 140 drives motors, sensors, and the like that operate in the sheet feeder 3, the document reader 5, and the image forming unit 7 of the image forming apparatus 2. The driver 140 can be configured to drive motors and sensors in the binding apparatus 4.

The controller 100 is implemented by a combination of software and hardware. More specifically, the CPU 10 loads a program from the memory such as the ROM 30 and the HDD 40 into the RAM 20 and performs computation according to the program, thereby constructing the software controller. The controller 100 is implemented by such a software controller and the hardware such as an integrated circuit.

The main control unit 101 controls, that is, gives commands to, respective units of the controller 100.

The operation display control unit 102 displays data on the display panel 110 or reports, to the main control unit 101, data input via the display panel 110. Then, the main control unit 101 stores the information from the operation display control unit 102 in the setting information storing unit 106 or gives a command to each unit of the controller 100 according to the information from the operation display control unit 102.

The I/O control unit 103 inputs information input via the network I/F 130 to the main control unit 101. Then, the main control unit 101 stores the information input from the I/O control unit 103 in the setting information storing unit 106 or gives a command to each unit of the controller 100 according to the information from the I/O control unit 103.

In this way, the main control unit 101 uses the operation display control unit 102 and the I/O control unit 103 to acquire the setting information such as sheet information, image data, and various types of information such as a print job.

Under control by the main control unit 101, the image processing unit 104 generates drawing data, as output data, according to image data written by a page description language (PDL), such as document data or image data included in the input print job. The drawing data is, e.g., bitmap data of cyan, magenta, yellow, and black, according to which the image forming apparatus 2 forms an image.

The image processing unit 104 also processes the captured image data input from the document reader 5 and generates image data. In the present embodiment, instead of image data, drawing data can be directly input to the image forming apparatus 2 so that the image forming apparatus 2 outputs an image according to the drawing data.

The signal input control unit 105 inputs a detection signal and a measurement signal input from each sensor to the main control unit 101. Then, the main control unit 101 inputs the detection signal and the measurement signal input from the signal input control unit 105 to the drive control unit 107.

The setting information storing unit 106 stores setting information such as sheet information. The drive control unit 107 controls the operation of the driver 140.

In FIG. 3, the display panel 110 and the operation button 120 together construct a control panel 301.

Figure 4:
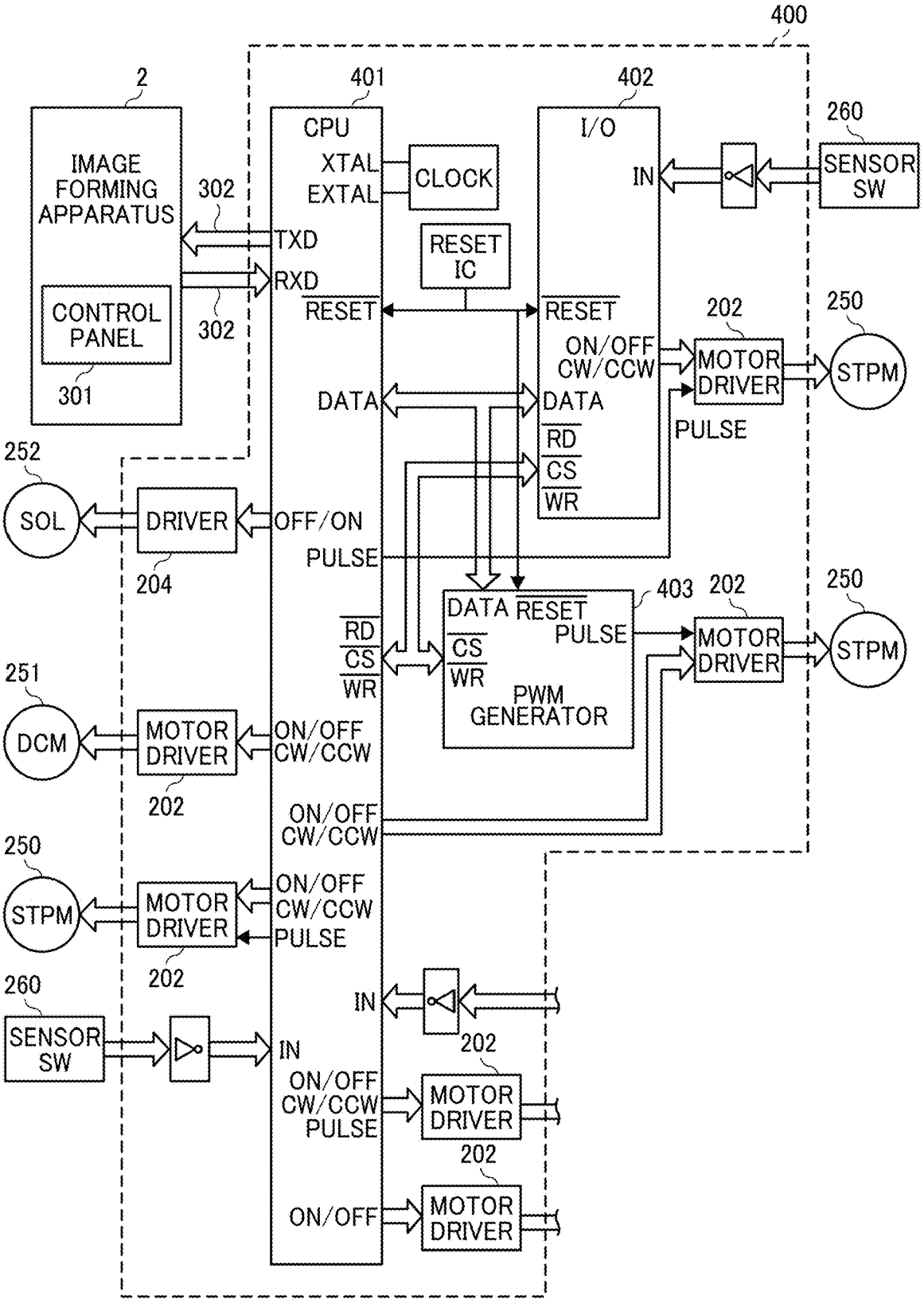
FIG. 4 is a block diagram illustrating a control configuration of a binding apparatus common to first and second embodiments.

FIG. 4 is a block diagram illustrating a control configuration of the binding apparatus 4. A controller 400 of the binding apparatus 4 includes a control circuit equipped with a microcomputer including a CPU 401, an I/O interface 402, and the like. A signal from the controller 100 or the control panel 301 of the image forming apparatus 2 is input to the CPU 401 via a communication interface 302. The CPU 401 executes predetermined control operation based on the input signal.

Further, the CPU 401 drives and controls a direct-current (DC) solenoid 252, a DC motor 251, and a stepping motor 250 via a driver 204 and motor drivers 202, and acquires information on sensor switches 260 via an interface. The CPU 401 controls via the I/O interface 402 some of the stepping motors 250 and acquires via the I/O interface 402 information from some of the sensor switches 260. Further, some of the stepping motors 250 may be controlled based on a pulse signal generated by a pulse-width modulation (PWM) generator 403.

Note that the CPU 401 reads and develops program codes stored in a memory such as a ROM of the controller 400 into a RAM and executes the control operations based on a program defined by the program codes while using the RAM as a work area and a data buffer. The controller 400 further includes a nonvolatile memory to store data used for control operations.

As illustrated in FIG. 4, the binding apparatus 4 includes the dedicated controller 400, but alternatively, the controller 100 of the image forming apparatus 2 may control the binding apparatus 4.

Figure 5:
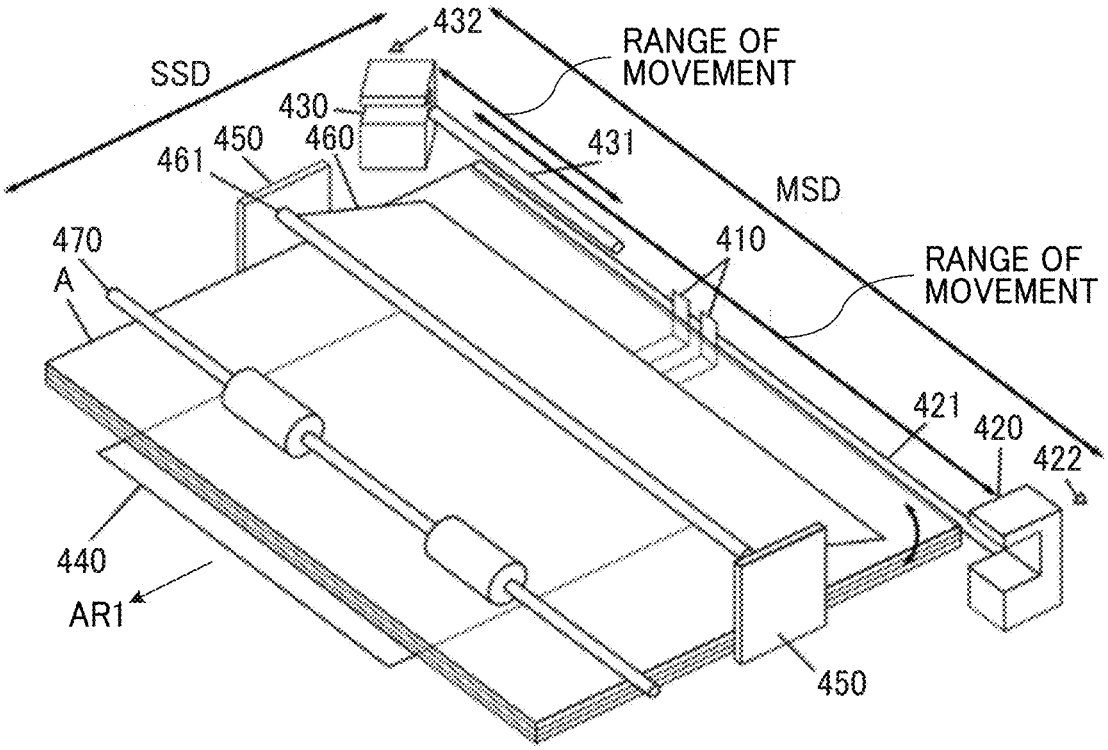
FIG. 5 is a perspective view illustrating an interior of a binding apparatus according to a first embodiment.
Figure 6:
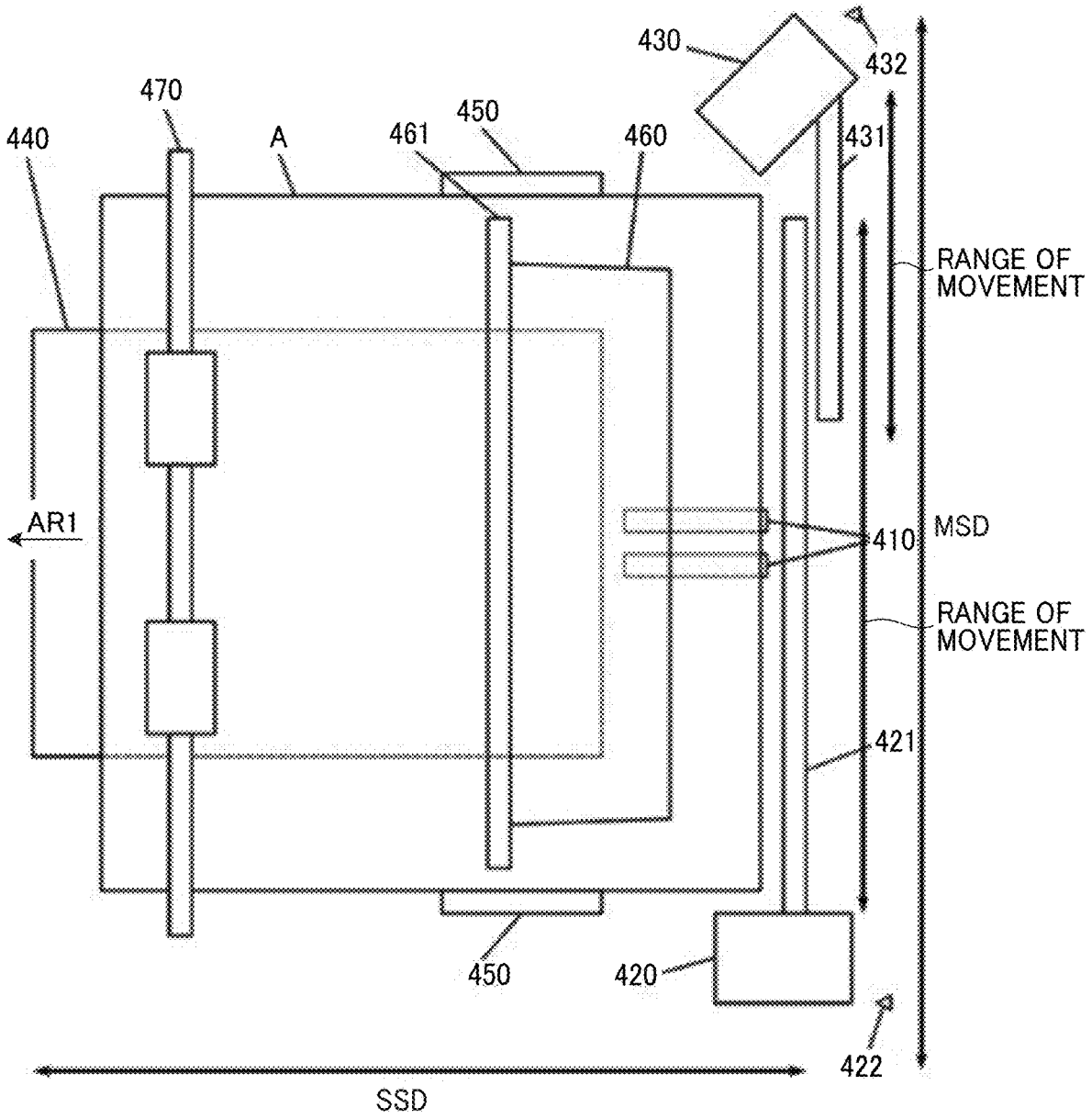
FIG. 6 is a top view illustrating the interior of the binding apparatus according to the first embodiment.
Figure 7:
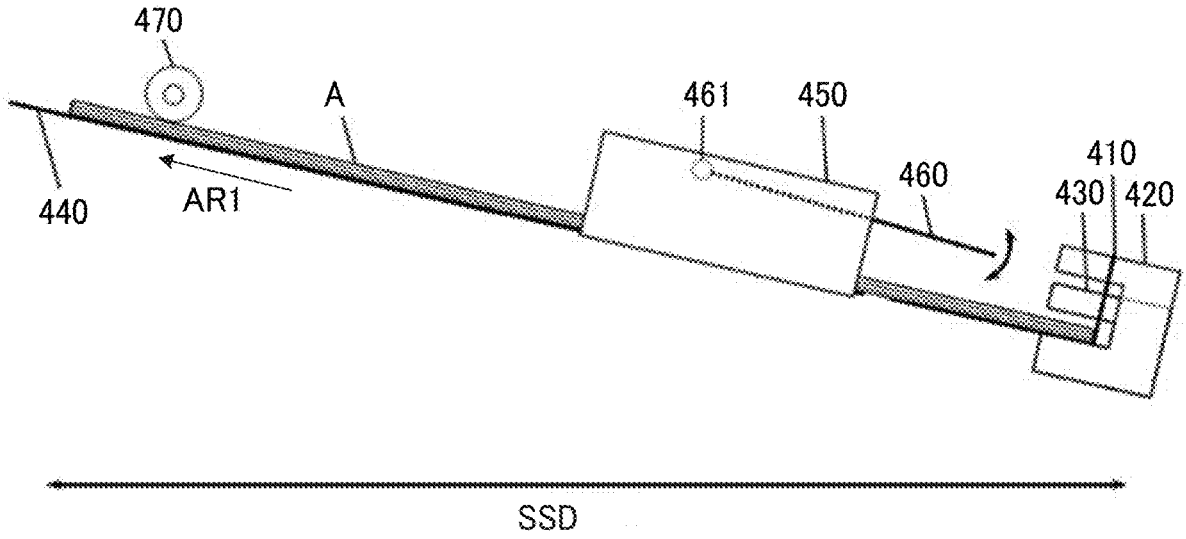
FIG. 7 is a side view illustrating the interior of the binding apparatus according to the first embodiment, as viewed in a main scanning direction.

Next, a description is given below of a configuration of the binding apparatus 4 with reference to FIGS. 5 to 7. FIG. 5 is a perspective view illustrating an interior of the binding apparatus 4 according to the present embodiment. FIG. 6 is a top view illustrating the interior of the binding apparatus 4 according to the present embodiment. FIG. 7 is a side view illustrating the interior of the binding apparatus 4 according to the present embodiment, as viewed in a main scanning direction MSD (see FIG. 6).

As illustrated in FIGS. 5 to 7, the binding apparatus 4 according to the present embodiment includes a trailing end alignment stopper 410, a staple binding unit 420, a staple binding unit guide rail 421, a staple binding unit sensor 422, a stapleless binding unit 430, a stapleless binding unit guide rail 431, a stapleless binding unit sensor 432, a sheet stacking plate 440, a pair of jogger fences 450, a movable guide plate 460, a guide plate rotation fulcrum 461, and a conveyance roller 470.

The trailing end alignment stopper 410 aligns a sheet bundle A as the trailing end of the sheets stacked on the sheet stacking plate 440 in a sheet conveyance direction indicated by arrow AR1 contacts the trailing end alignment stopper 410.

Figure 8:
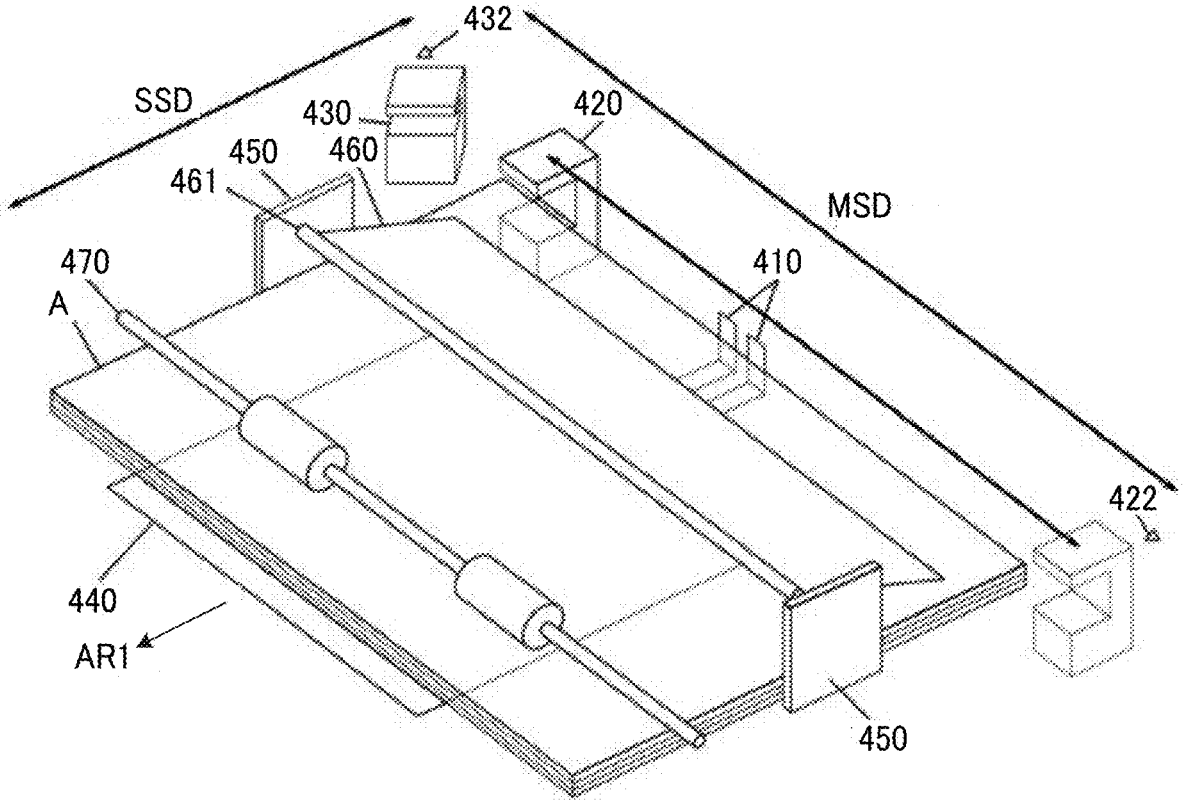
FIG. 8 is a perspective view illustrating the interior of the binding apparatus according to the first embodiment.

The staple binding unit 420 is positioned at a standby position, which is a reference position, before the binding process and moves from the standby position along the staple binding unit guide rail 421 to a binding position as illustrated in FIG. 8.

Figure 9:
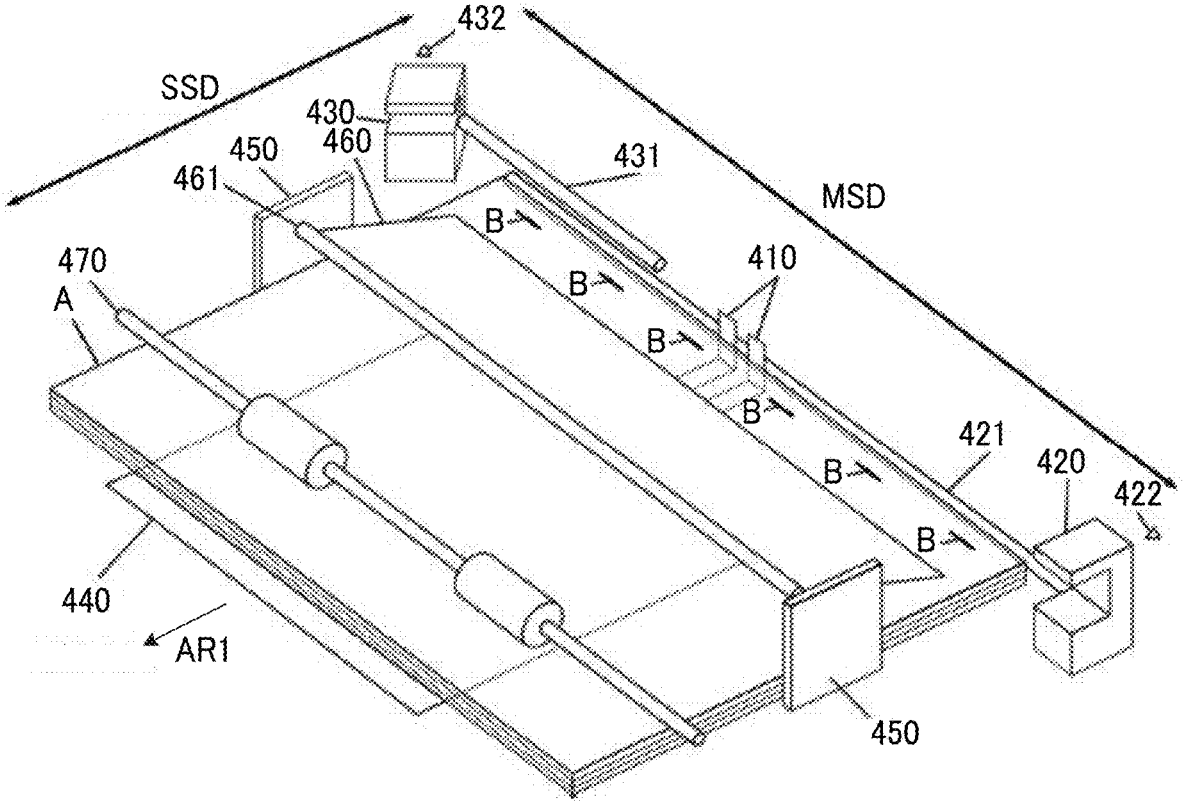
FIG. 9 is a perspective view illustrating the interior of the binding apparatus according to the first embodiment.
Figure 10:
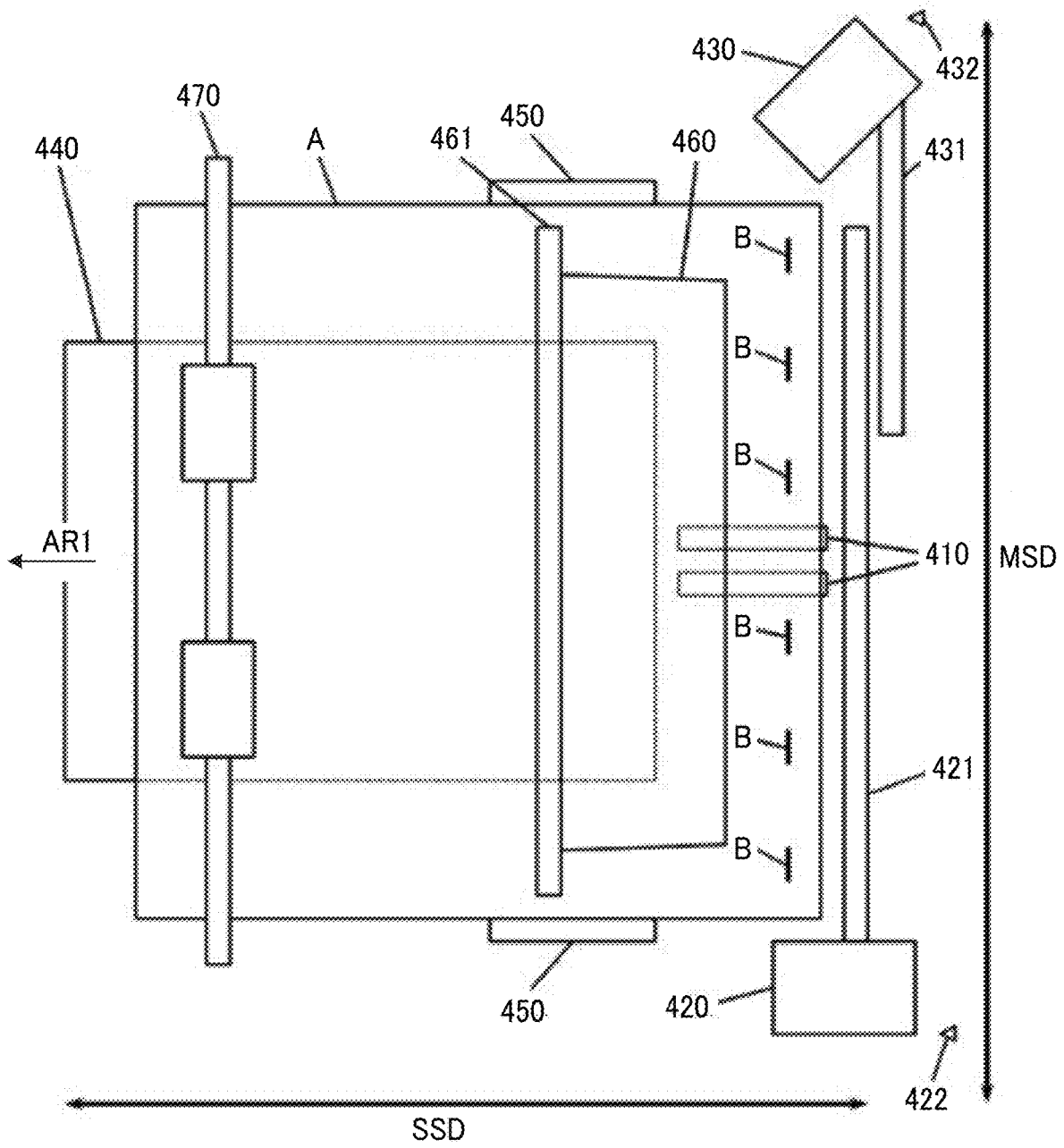
FIG. 10 is a top view illustrating the interior of the binding apparatus according to the first embodiment.
Figure 11:
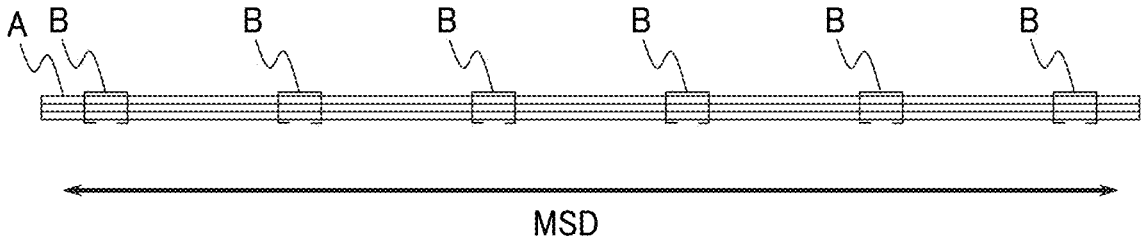
FIG. 11 is a side view of a sheet bundle bound by a staple binding unit according to the first embodiment, as viewed in a sub-scanning direction.

Then, while sandwiching the sheet bundle A from above and below the sheet surfaces with the binding opening, the staple binding unit 420 strikes staples B through the sheet bundle A at the plurality of positions as illustrated in FIGS. 9 to 11, thereby binding the sheet bundle A. FIGS. 9 to 11 illustrate the example of striking the staples B at a plurality of positions at equal intervals, but the sheet bundle A can be bound at only one position (for example, one corner of the sheet bundle A). The number of the staples B and the stapling points can be set by the user.

When the series of binding operations for the sheet bundle A is completed, the staple binding unit 420 returns to the standby position along the staple binding unit guide rail 421. At this time, with the staple binding unit sensor 422, the binding apparatus 4 detects that the staple binding unit 420 is at the standby position, or the staple binding unit 420 has returned to the standby position.

Figure 12:
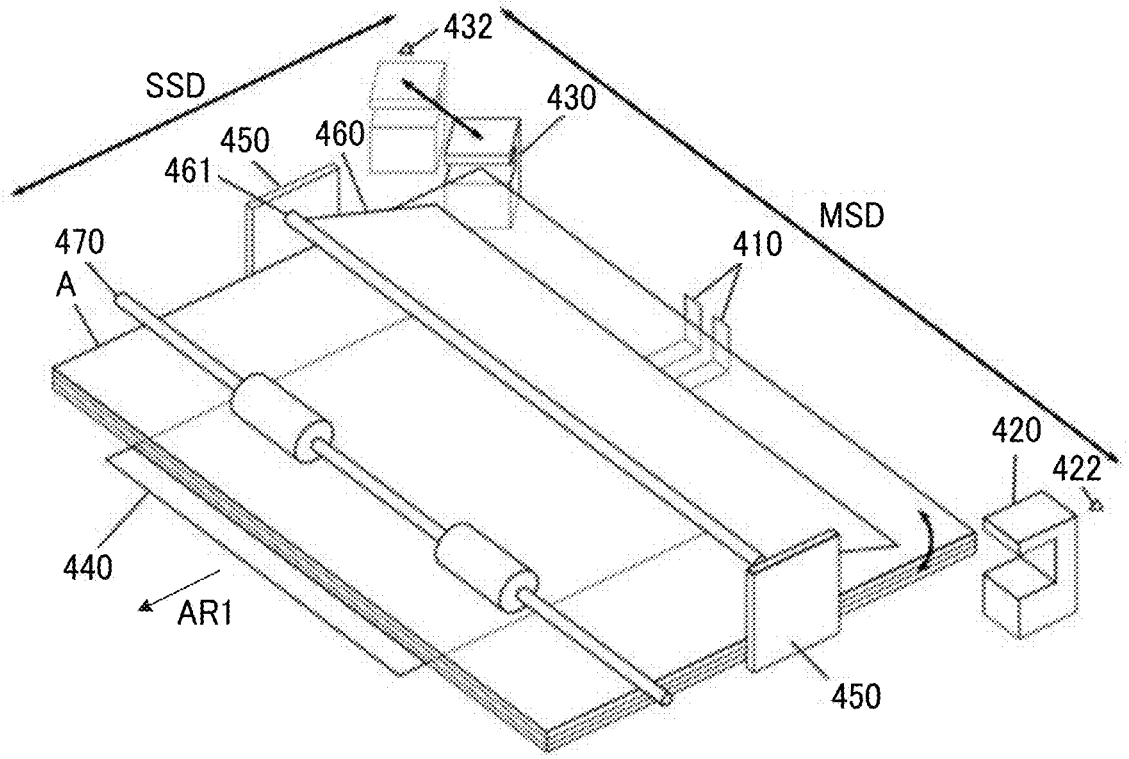
FIG. 12 is a perspective view illustrating the interior of the binding apparatus according to the first embodiment.

The stapleless binding unit 430 is positioned at a standby position, which is a reference position, before the binding process and moves from the standby position along the stapleless binding unit guide rail 431 to a binding position as illustrated in FIG. 12.

Figure 13A:
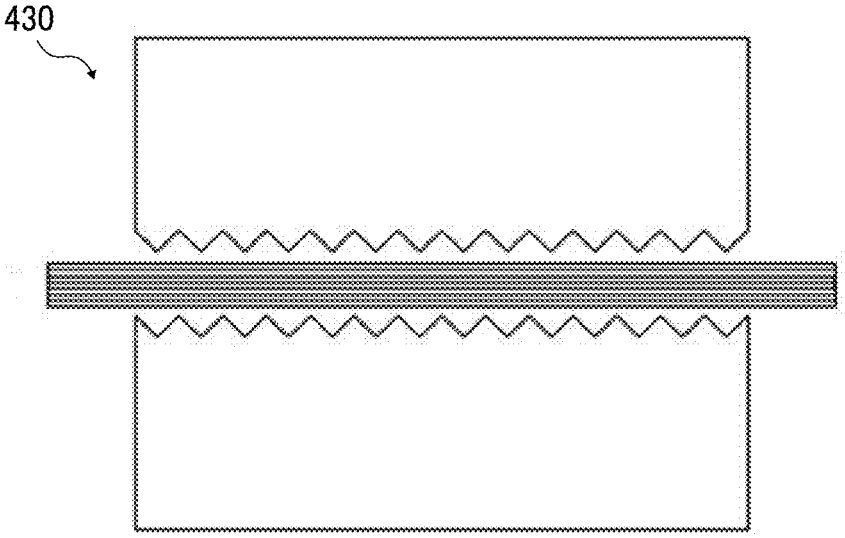
FIGS. 13A and 13B are side views illustrating an operation of a stapleless binding unit according to the first embodiment, as viewed in a main scanning direction.
Figure 13B:
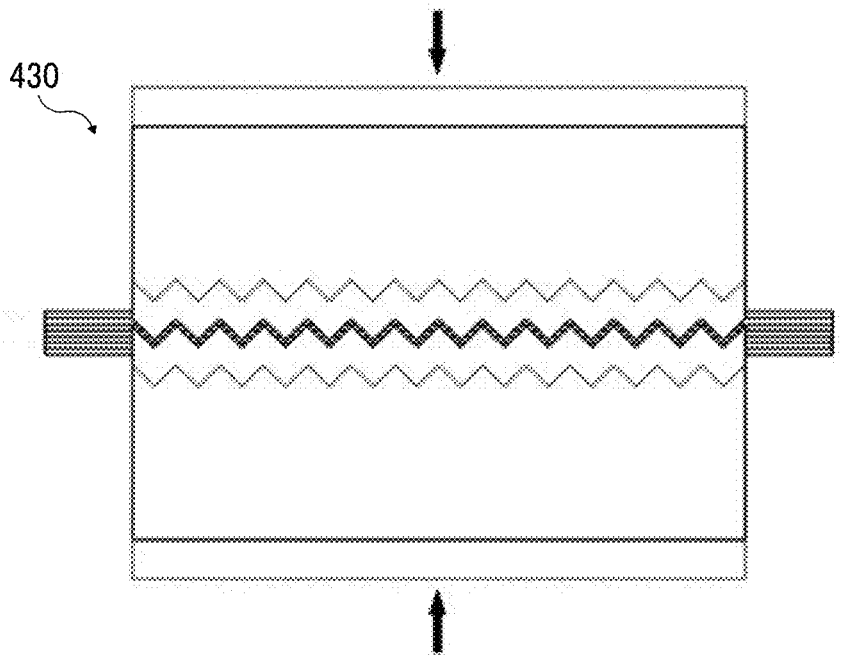
Figure 14:
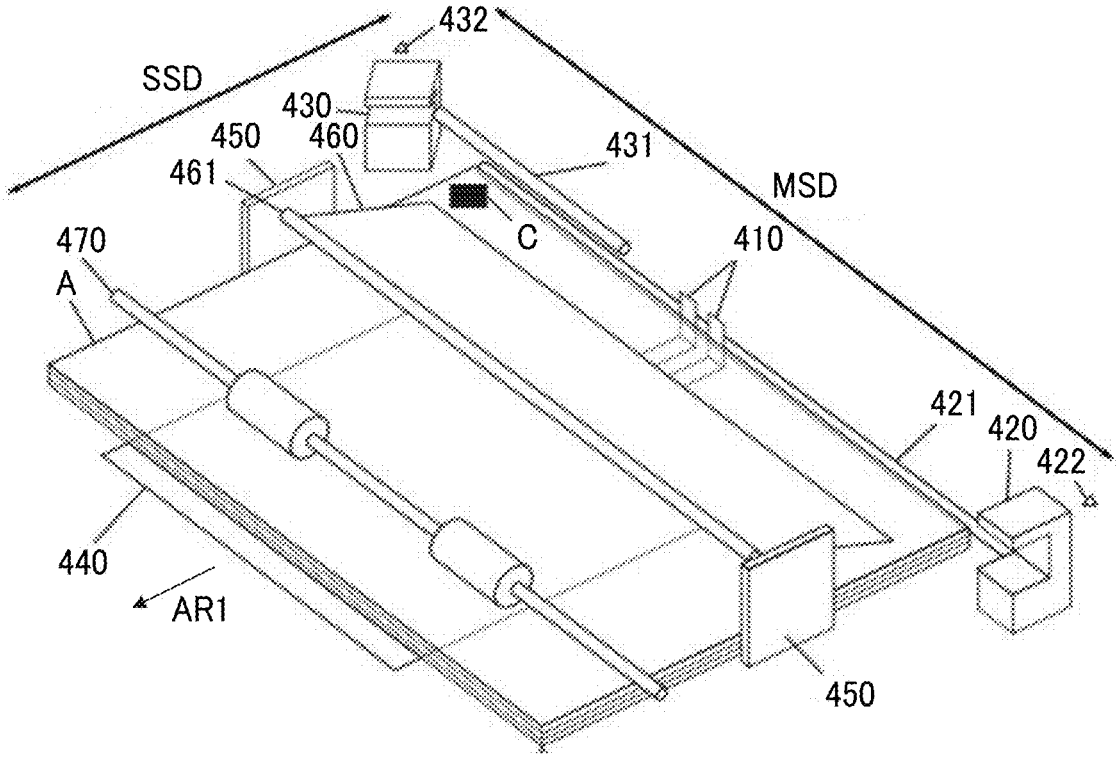
FIG. 14 is a perspective view illustrating the interior of the binding apparatus according to the first embodiment.
Figure 15:
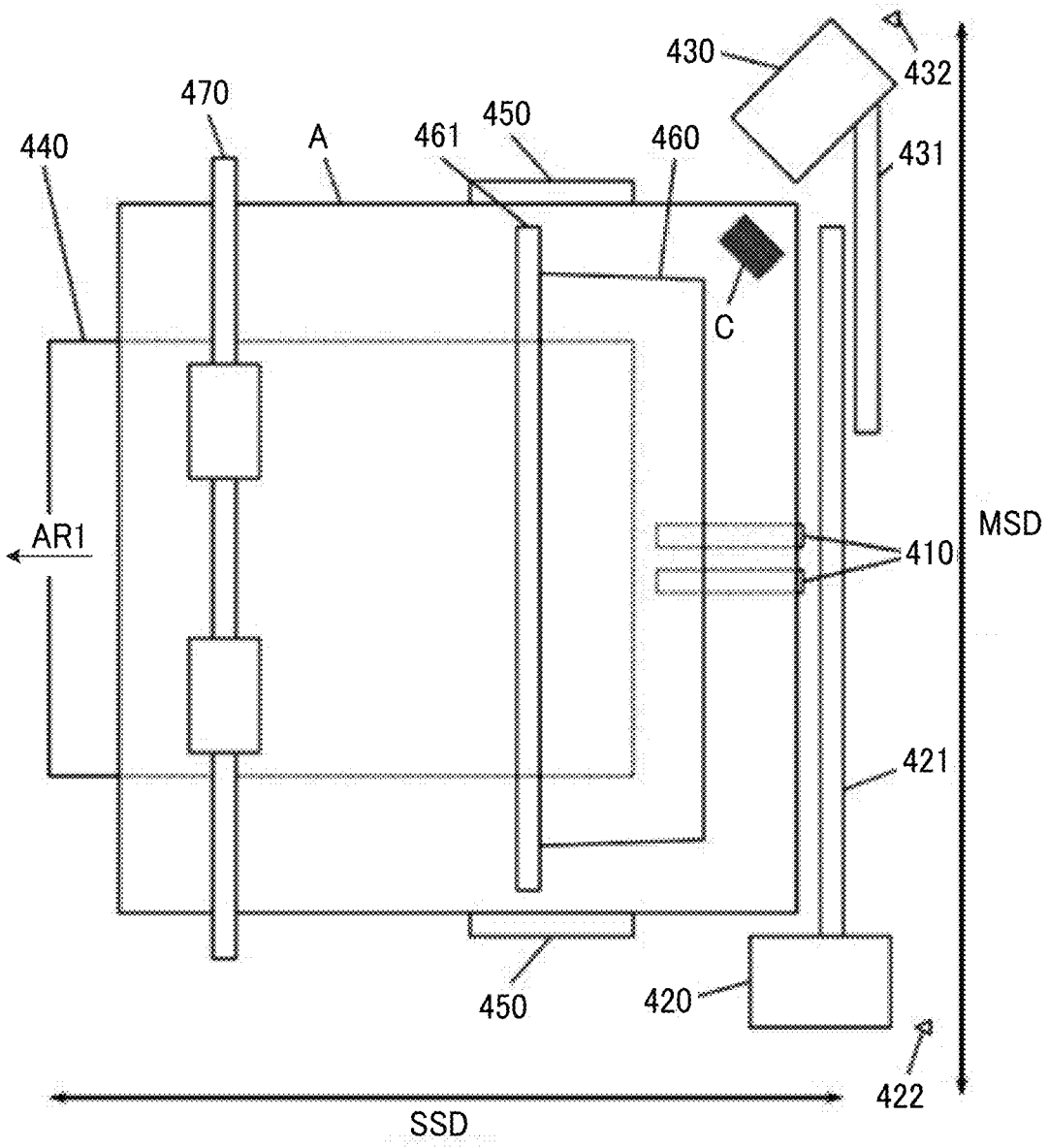
FIG. 15 is a top view illustrating the interior of the binding apparatus according to the first embodiment.
Figure 16:
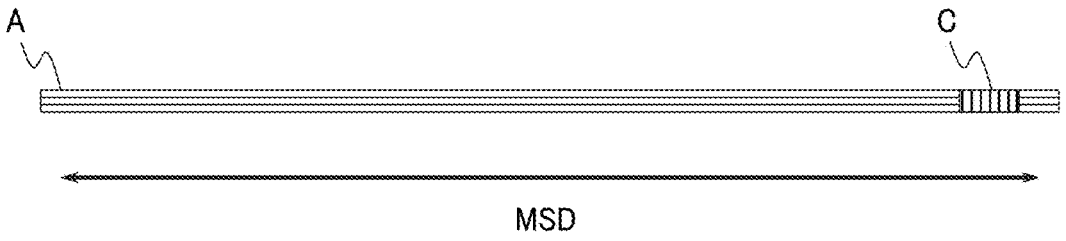
FIG. 16 is a side view of a sheet bundle bound by a stapleless binding unit according to the first embodiment, as viewed in the sub-scanning direction.

The stapleless binding unit 430 has a binding opening provided with toothlike pressing members (an upper toothlike portion 505 and a lower toothlike portion 506 described later) that mesh with each other vertically. As illustrated in FIGS. 13A and 13B, at the binding position, the stapleless binding unit 430 presses the sheet bundle A from above and below the sheet surfaces with the binding opening, thereby binding the sheet bundle A. As illustrated in FIGS. 14 to 16, the sheet bundle A pressed in this manner is bound by the fibers entwined between the sheets at a binding position C.

When the series of binding operations for the sheet bundle A is completed, the stapleless binding unit 430 returns to the standby position along the stapleless binding unit guide rail 431. At this time, with the stapleless binding unit sensor 432, the binding apparatus 4 detects that the stapleless binding unit 430 is at the standby position, or the stapleless binding unit 430 has returned to the standby position.

Figure 17:
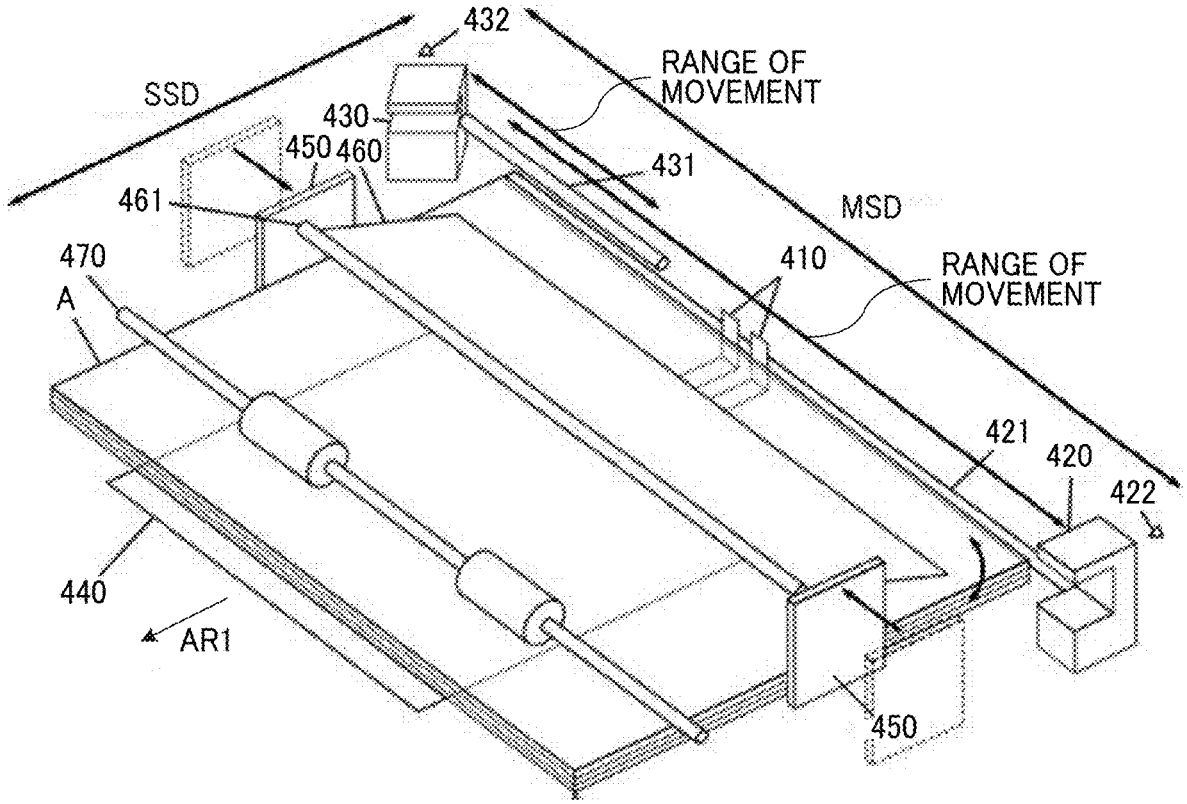
FIG. 17 is a perspective view illustrating the interior of the binding apparatus according to the first embodiment.

The sheet stacking plate 440 is for stacking the sheets until all the sheets to be bound are conveyed thereto. As illustrated in FIG. 17, the jogger fences 450 are disposed at both ends in the sheet width direction of the sheet bundle A stacked on the sheet stacking plate 440. The jogger fences 450 move in the main scanning direction MSD in which the jogger fences 450 face each other and press against both ends of the sheet bundle A in the sheet width direction. As a result, both ends of the sheet bundle A in the sheet width direction are aligned.

The conveyance roller 470 conveys the sheet conveyed to the sheet stacking plate 440 in reverse to the upstream side in the sheet conveyance direction AR1 and brings the end of the sheet into contact with the trailing end alignment stopper 410. Further, the conveyance roller 470 ejects the sheet bundle A after the binding to the output tray 6*b*.

Here, a series of operations by the members illustrated in FIGS. 5 to 17 is described. The description is made mainly with reference to FIG. 7.

The conveyance roller 470 is capable of forward and reverse rotations and vertical movement between a contact position in contact with the sheet stacking plate 440 and a separated position from the sheet stack plate 440. When the conveyance roller 470 is located at the separated position, a conveyor conveys the sheet in the sheet conveyance direction AR1 (from the right to the left in FIG. 7), from above the movable guide plate 460, through the space between the conveyance roller 470 and the movable guide plate 460 and 470. Then, the sheet is conveyed between the conveyance roller 470 and the sheet stacking plate 440.

When the trailing end of the sheet is conveyed downstream from the movable guide plate 460 in the conveyance direction AR1, the conveyance roller 470 is moved to the contact position and rotated counterclockwise in FIG. 7 (reverse direction). As a result, the sheet is returned to the upstream side in the conveyance direction AR1 along the sheet stacking plate 440, and the trailing end of the sheet in the conveyance direction AR1 passes between the movable guide plate 460 and the sheet stacking plate 440 and contacts the trailing end alignment stopper 410.

After the contact, the conveyance roller 470 is moved to the separated position and stopped rotating. The above operation is repeated every time the sheet is conveyed until the number of sheets conveyed reaches the predetermined number. Further, every time the sheet is conveyed, the pair of jogger fences 450 is moved to perform the alignment.

When the number of sheets reaches the predetermined number, binding is performed. When the binding is completed, the conveyance roller 470 moves to the contact position and rotates clockwise (forward direction) in FIG. 7. As a result, the bound sheet bundle A is conveyed in the sheet conveyance direction AR1 along the sheet stacking plate 440 and ejected onto the output tray 6*b*.

Figure 18:
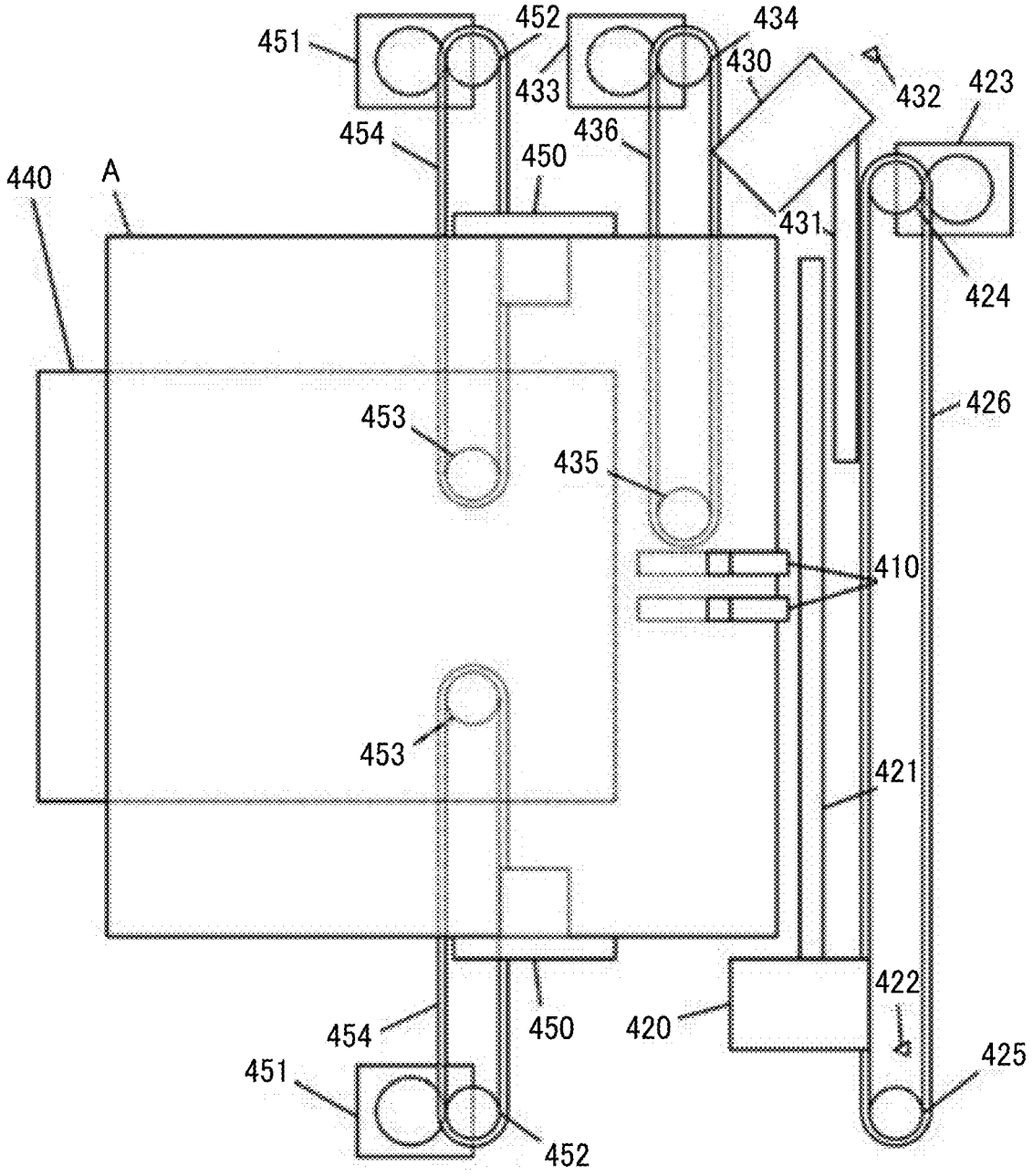
FIG. 18 is a top view illustrating the interior of the binding apparatus according to the first embodiment.
Figure 19A:
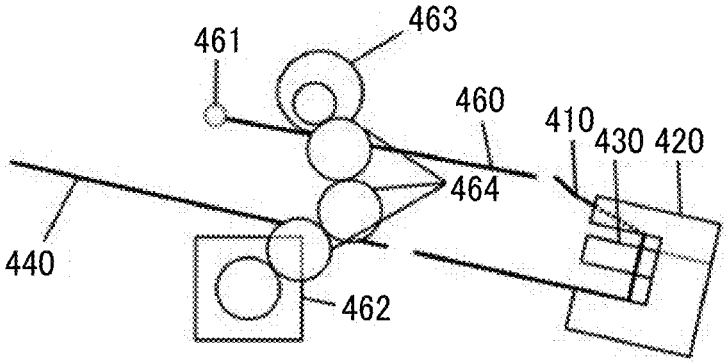
FIGS. 19A and 19B are side views illustrating the interior of the binding apparatus according to the first embodiment, as viewed in the main scanning direction.
Figure 19B:
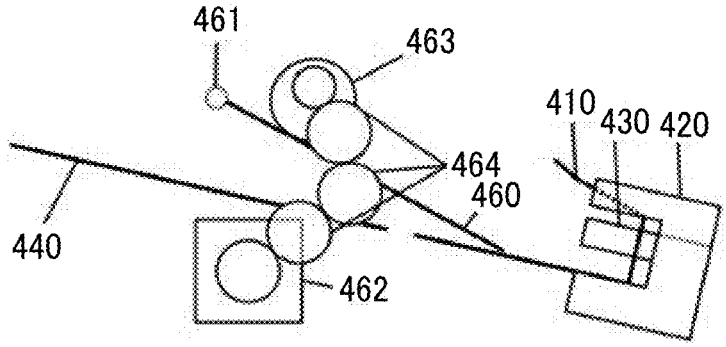

Next, the mechanism of the binding apparatus 4 according to the present embodiment is described with reference to FIGS. 18, 19A, and 19B. FIG. 18 is a top view illustrating the interior of the binding apparatus 4 according to the present embodiment, FIGS. 19A and 19B are side views illustrating the interior of the binding apparatus 4 according to the present embodiment, as viewed in the main scanning direction.

As illustrated in FIG. 18, the staple binding unit 420 moves along the staple binding unit guide rail 421, driven by the staple binding unit drive motor 423 via an endless belt 426 bridged between a drive pulley 424 and a driven pulley 425.

The stapleless binding unit 430 moves along the stapleless binding unit guide rail 431, driven by a stapleless binding unit drive motor 433 via an endless belt 436 bridged between a drive pulley 434 and a driven pulley 435.

The pair of jogger fences 450 moves, driven by a jogger fence drive motor 451 via an endless belt 454 stretched between a drive pulley 452 and a driven pulley 453.

As illustrated in FIGS. 19A and 19B, as a guide plate drive motor 462 rotates an eccentric cam 463 via a gear train 464, the movable guide plate 460 rotates about the guide plate rotation fulcrum 461. The movable guide plate 460 is moved to the position illustrated in FIG. 19B at the start of a job. The guide plate drive motor 462 is driven in accordance with the number of sheets stacked on the sheet stacking plate 440, to rotate the eccentric cam 463. As a result, the interval between the leading end of the movable guide plate 460 and the sheet stacking plate 440 is gradually widened.

Figure 20:
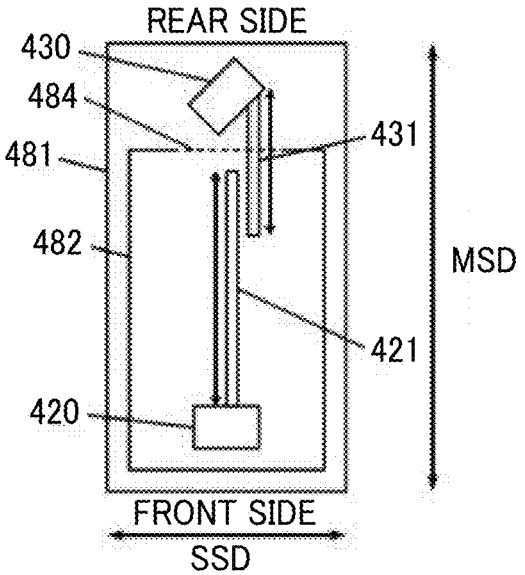
FIG. 20 is a top view illustrating the periphery of the staple binding unit and the stapleless binding unit in the binding apparatus according to the first embodiment.
Figure 21A:
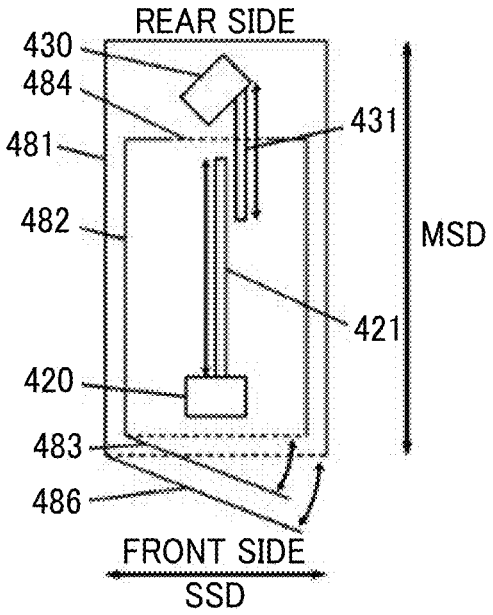
FIGS. 21A and 21B are top views illustrating the periphery of the staple binding unit and the stapleless binding unit in the binding apparatus according to the first embodiment.
Figure 21B:
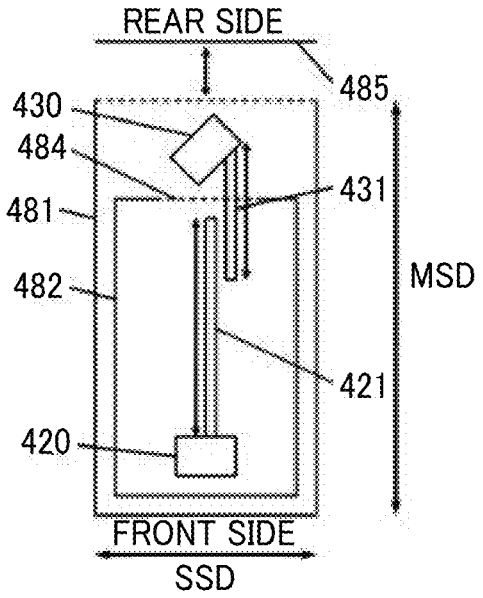

Next, a description is given below of an arrangement of the staple binding unit 420 and the stapleless binding unit 430 in the binding apparatus 4, with reference to FIGS. 20, 21A, and 21B. FIGS. 20, 21A, and 21B are top views illustrating the periphery of the staple binding unit 420 and the stapleless binding unit 430 in the binding apparatus 4.

As illustrated in FIG. 20, the binding apparatus 4 includes an exterior cover 481 and a frame 482. The exterior cover 481 covers the entire binding apparatus 4. The frame 482 is covered with the exterior cover 481. The frame 482 supports, at both ends in the direction of movement of the staple binding unit 420 and the stapleless binding unit 430, a sheet conveyance passage through which the sheets are conveyed.

Further, as illustrated in FIG. 20, inside the exterior cover 481 of the binding apparatus 4, the staple binding unit 420 is on the front side of the apparatus and the stapleless binding unit 430 is on the rear side of the apparatus. The staple binding unit 420 and the stapleless binding unit 430 move inside the frame 482 in the main scanning direction.

As illustrated in FIG. 21A, the binding apparatus 4 includes a closably openable front cover 486 on the front side of the exterior cover 481 and an openable frame cover 483 on the front side of the frame 482. The openable frame cover 483 is closably openable, together with the openable front cover 486, to the front side of the frame 482.

In the binding apparatus 4 according to the present embodiment, since the staple binding unit 420 is disposed on the front side of the apparatus, and the front side of the apparatus is openable with the openable front cover 486, replenishing the staple binding unit 420 with staples can be easy.

The stapleless binding unit 430 does not need to be replenished with staples and normally does not need to be accessed. Therefore, disposing the stapleless binding unit 430 on the rear side of the apparatus does not cause an inconvenience. However, access to the stapleless binding unit 430 is necessary for repair or maintenance of the stapleless binding unit 430. It is difficult for a user to access the stapleless binding unit 430 disposed on the rear side of the apparatus.

Therefore, as illustrated in FIG. 21B, in the binding apparatus 4, an opening 484 is provided on the rear side of the frame 482 so that the stapleless binding unit 430 can pass therethrough. As illustrated in FIG. 21B, the stapleless binding unit 430 is movable in the main scanning direction MSD to enter and exit the frame 482 from the opening 484.

Further, as illustrated in FIG. 21B, the binding apparatus 4 includes an openable rear cover 485 on the rear side of the exterior cover 481.

In the binding apparatus 4, the openable rear cover 485 is fixed to the exterior cover 481 or the frame 482 with a fixing member such as a screw. The openable rear cover 485 is not usually opened but is opened at the time of repair or maintenance of the stapleless binding unit 430.

As described above, in the binding apparatus 4 according to the present embodiment, the entire stapleless binding unit 430 can be moved out the frame 482 on the apparatus rear side, and the apparatus rear side can be opened and closed with the openable rear cover 485.

This allows the user to easily access the stapleless binding unit 430 without disassembling or removing the frame 482. Therefore, when the stapleless binding unit 430 requires repair or maintenance, the user can easily access the stapleless binding unit 430.

In the embodiment described above, in the binding apparatus 4, the stapleless binding unit 430 is movable on the rear side of the apparatus so that the entire stapleless binding unit 430 comes out the frame 482. Alternatively, the stapleless binding unit 430 can be moved so that only a portion of the stapleless binding unit 430 comes out the frame 482. With such a configuration, the binding apparatus 4 can be made compact.

In the binding apparatus 4 according to the present embodiment, the stapleless binding unit 430 moves to the outside of the frame 482 on the rear side of the apparatus. Alternatively, the standby position of the stapleless binding unit 430 can be set to a position outside the frame 482. Such a configuration can obviate moving the stapleless binding unit 430 to the outside of the frame 482 in order to access the stapleless binding unit 430.

The description has been given of the binding apparatus 4 in which the staple binding unit 420 is disposed on the front side of the apparatus, and the stapleless binding unit 430 is disposed on the rear side of the apparatus. Alternatively, the staple binding unit 420 can be disposed on the rear side of the apparatus, and the stapleless binding unit 430 can be disposed on the front side of the apparatus. Such a configuration can facilitate the access to the stapleless binding unit 430.

In the binding apparatus 4 described above, the stapleless binding unit 430 is movable, on the rear side of the apparatus, to the outside of the frame 482. In addition, the staple binding unit 420 can be moved to the outside of the frame 482 on the front side of the apparatus. Such a configuration can facilitate supply of staples to the staple binding unit 420.

Second Embodiment

A detailed description is given of a second embodiment of the present disclosure with reference to the drawings. Note that elements according to the present embodiment similar to those of the first embodiment are given identical or similar reference characters, and thus descriptions thereof omitted.

Figure 22:
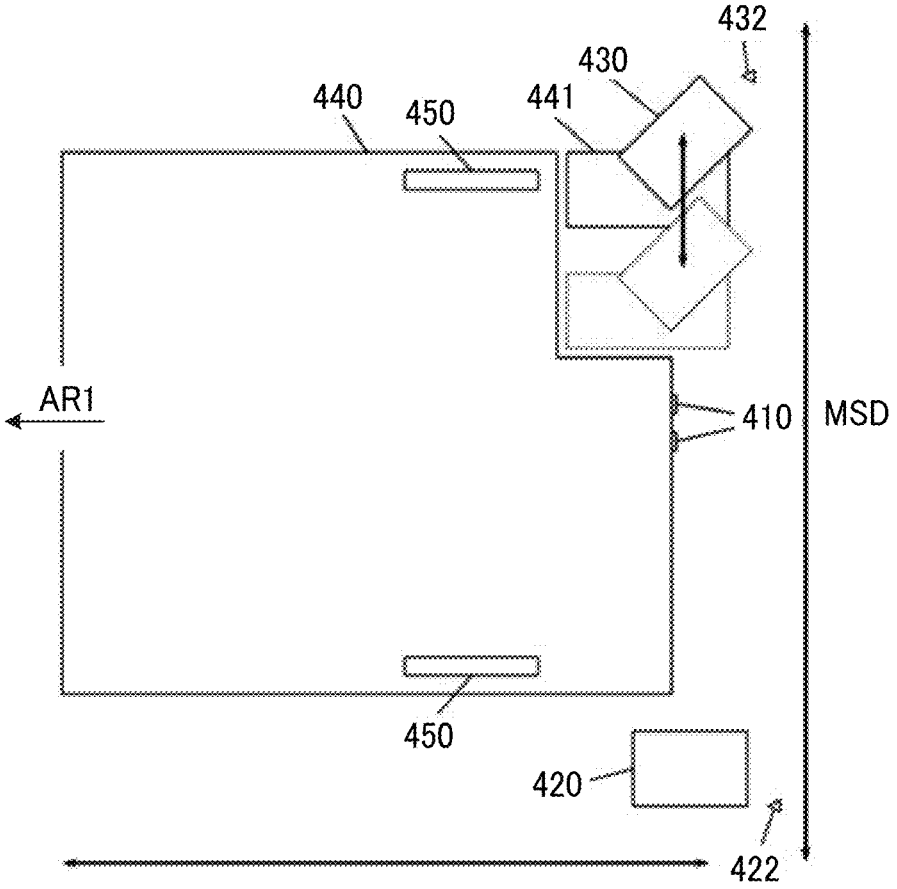
FIG. 22 is a top view illustrating the interior of a binding apparatus according to the second embodiment.

FIG. 22 is a top view illustrating the interior of the binding apparatus 4 according to the second embodiment. Similar to the first embodiment, in the binding apparatus 4 according to the second embodiment, the staple binding unit 420 is on the front side of the apparatus, and the stapleless binding unit 430 on the rear side of the apparatus.

Further, the binding apparatus 4 according to the second embodiment conveys the sheet with reference to the front side of the apparatus or the center of the apparatus. The reason is as follows. In the case of sheet conveyance with reference to the rear side of the apparatus, removal of a jammed sheet is difficult at the occurrence of jamming. In particular, when a small sheet is jammed, removal thereof is difficult.

In the binding apparatus 4 according to the second embodiment, the stapleless binding unit 430 on the rear side of the apparatus needs to move in the main scanning direction MSD to be able to bind both a minimum size sheet and a maximum size sheet.

Further, in the binding apparatus 4 according to the second embodiment, the stapleless binding unit 430 performs stapleless binding a state in which the stapleless binding unit 430 is tilted, for example, by 45 degrees with respect to the sheets in order to enhance the binding force.

In the second embodiment, the width of the sheet stacking plate 440 in the main scanning direction MSD is smaller than the width of the maximum size sheet in the main scanning direction MSD and larger than the width of the minimum size sheet in the main scanning direction MSD. Therefore, in the case of binding the minimum size sheets, while the stapleless binding unit 430 moves from the standby position to the binding position, the rear side of the binding opening may collide with the corner of the sheet stacking plate 440.

A conceivable approach to avoid such a collision is increasing the depth of the binding opening of the stapleless binding unit 430. However, the stapleless binding unit 430 needs to press the sheets with a very strong force, and the distance between the fulcrum and the action point, that is, the depth of the binding opening, is preferably as short as possible.

Therefore, in the second embodiment, as illustrated in FIG. 22, a portion of the sheet stacking plate 440 is cut away (cutout) in the range of movement of the stapleless binding unit 430. With this structure, even in the case of binding the minimum size sheets, the rear side of the binding opening does not collide with the corner of the sheet stacking plate 440 while the stapleless binding unit 430 moves from the standby position to the binding position.

Figure 23:
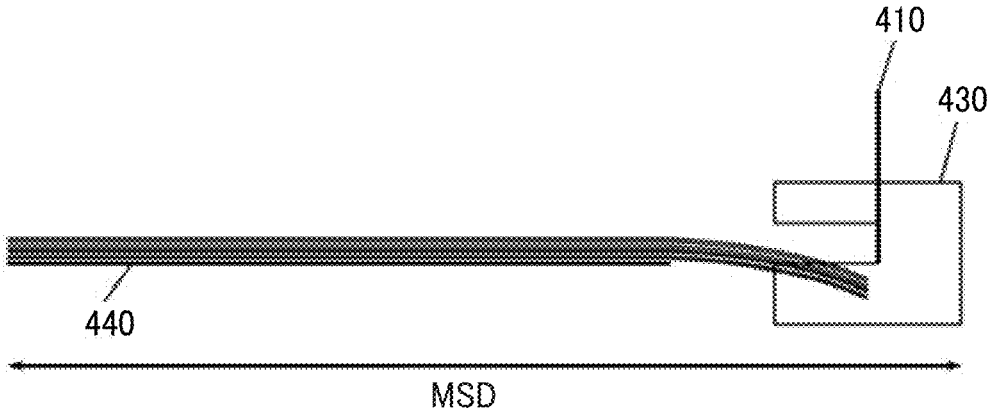
FIG. 23 is a side view illustrating the interior of the binding apparatus according to the second embodiment, as viewed in the sub-scanning direction.

However, in this structure, as illustrated in FIG. 23, the sheet bundle A may hang down at the cutout portion of the sheet stacking plate 440.

When the binding apparatus 4 attempts to move the stapleless binding unit 430 from the standby position to the binding position in such a state, the binding opening of the stapleless binding unit 430 collides with the end of the sheet bundle A in the main scanning direction MSD. Therefore, in such a case, appropriate binding by the stapleless binding unit 430 is not available.

Therefore, as illustrated in FIG. 22, the binding apparatus 4 according to the second embodiment further includes a planar sheet support 441 that moves together with the stapleless binding unit 430 and supports the sheet bundle A in the binding direction so that the sheet bundle A does not hang down in the cutout portion of the sheet stacking plate 440.

Figure 24:
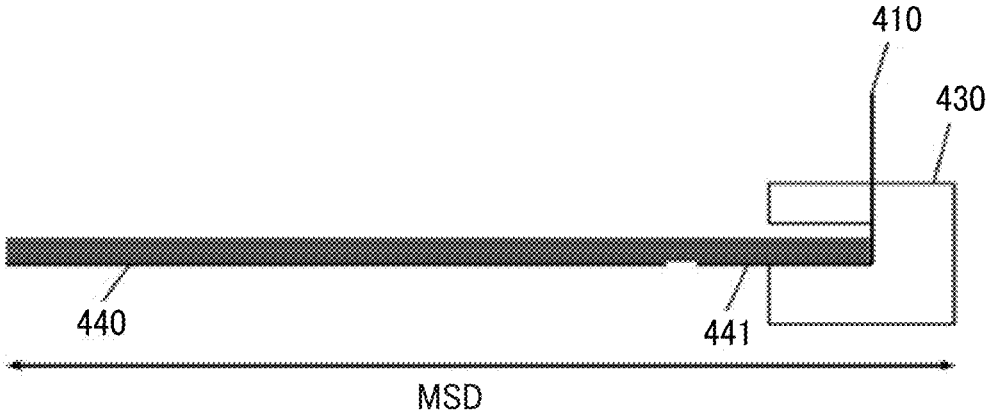
FIG. 24 is a side view illustrating the interior of the binding apparatus according to the second embodiment, as viewed in the sub-scanning direction.

With such a configuration, as illustrated in FIG. 24, the rear side of the binding opening of the stapleless binding unit 430 does not collide with the corner of the sheet stacking plate 440, and the stapleless binding unit 430 can receive the sheet bundle A at the binding opening.

Figure 25:
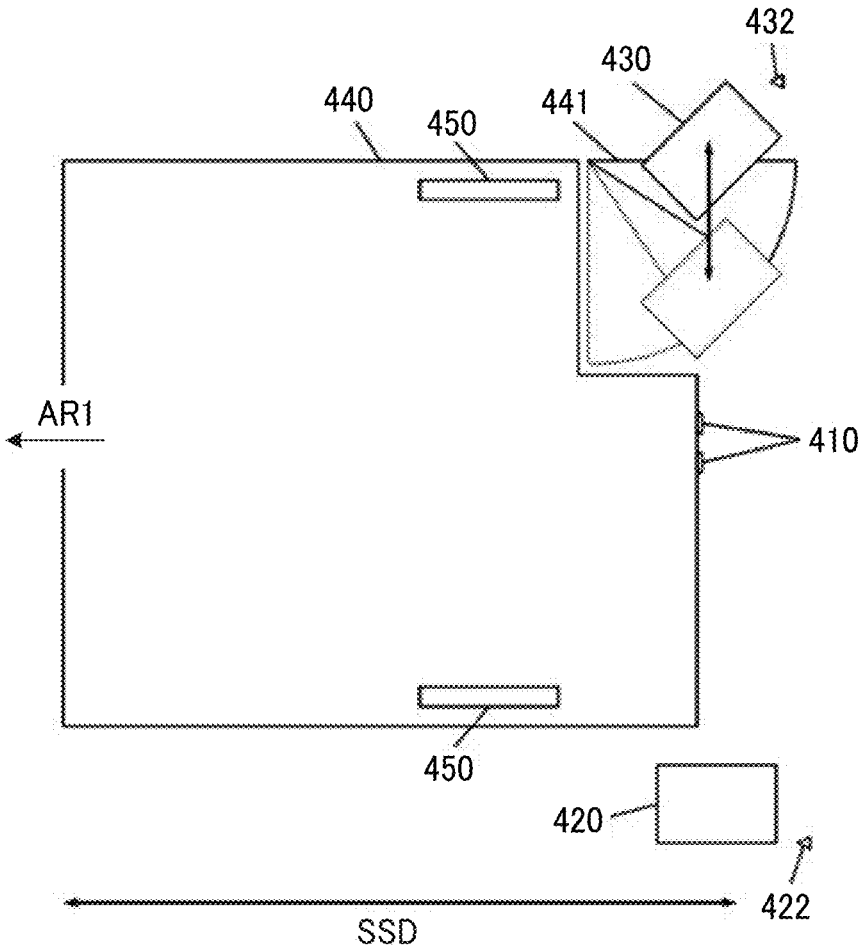
FIG. 25 is a top view illustrating the interior of a binding apparatus according to the second embodiment.

In the second embodiment, the description is given of the binding apparatus 4 in which the planar sheet support 441 is secured to the stapleless binding unit 430. Alternatively, as illustrated in FIG. 25, the sheet support 441 can be configured to move independently from the stapleless binding unit 430 but in conjunction with the stapleless binding unit 430. In this case, a driver to drive the sheet support 441 can be separately provided.

In the second embodiment, the description is given of the binding apparatus 4 in which the staple binding unit 420 is disposed on the front side of the apparatus and the stapleless binding unit 430 is disposed on the rear side of the apparatus. Alternatively, the staple binding unit 420 can be disposed on the rear side of the apparatus, and the stapleless binding unit 430 can be disposed on the front side of the apparatus.

Descriptions are given in detail of a configuration and operation of the stapleless binding unit 430 described in the first and second embodiment, together with prevention of idle striking in the initial operation of the stapleless binding unit 430, which is common to the first and second embodiments.

In a stapleless binding unit including a cam, as the cam rotates unidirectionally in a forward direction, separation of the toothlike portions and pressing are repeated in conjunction with the rotation of the cam, thereby performing efficient and reliable binding.

In the case of such a stapleless binding unit having the cam, it is necessary to rotate the cam to move the upper and lower toothlike portions to the home positions, to open the binding opening largely prior to the binding. Therefore, at the power on or in preparation, the stapleless binding unit performs an initial operation to rotate the cam in the forward rotation, to move the toothlike portions to the home positions. Depending on the angle of the cam immediately before the initial operation, the cam passes the angle (peak position) at which the binding force is greatest in the initial operation. That is, in some cases, in the initial operation, the toothlike portions are directly pressed against each other without the sheets, which is referred to as "idle striking."

The toothlike portions are made of a high-strength material. However, in idle striking, the toothlike portions are pressed against each other and applied a strong force. Then, a local load may be applied thereto, damaging the toothlike portions and a pressure mechanism of the toothlike portions. This is a major cause of defective binding and damage to the apparatus. When the stapleless binding is performed on the sheet bundle, the sheet bundle serves as a cushion to disperse the load, so that the apparatus is not damaged.

In a binding apparatus that performs stapleless binding by rotation driving and returns the pressing portions (binding portions) to the home positions by forward rotation in the initial operation, the rotation in the initial operation may be reversed upon the occurrence of a load equal to or greater than a threshold (for example, maximum load) in forward rotation.

Normally, the rotation direction of the cam with good operation efficiency is made the forward direction of the rotation of the cam, and conversely, the rotation direction of low operation efficiency is reverse direction. If the cam performs reverse rotation with low operation efficiency under a high load condition, a heavy load may be applied to the drive mechanism such as a drive motor, damaging the drive mechanism.

Figure 26:
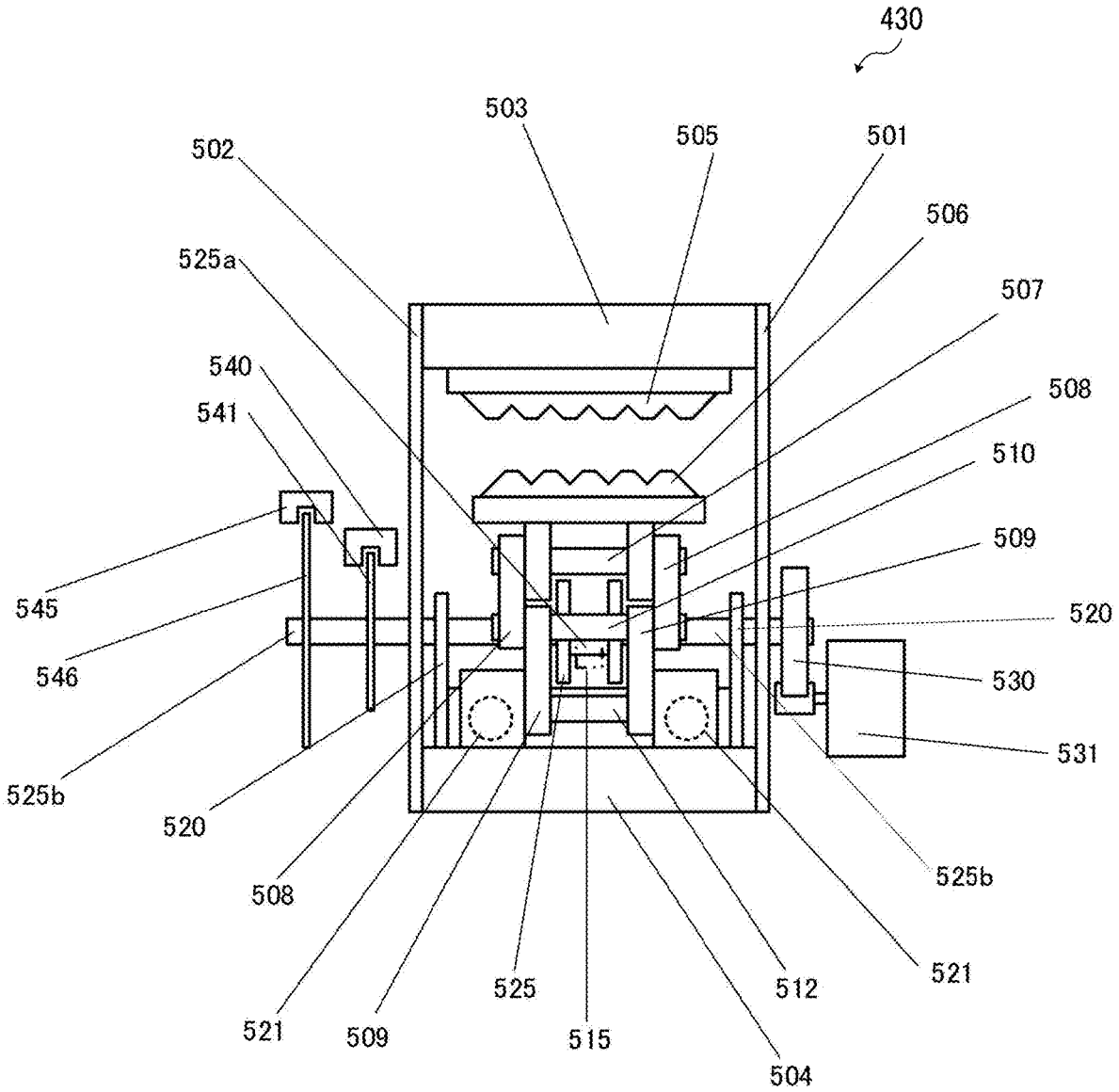
FIG. 26 is a side view illustrating a configuration of the stapleless binding unit common to the first and second embodiments.
Figure 27:
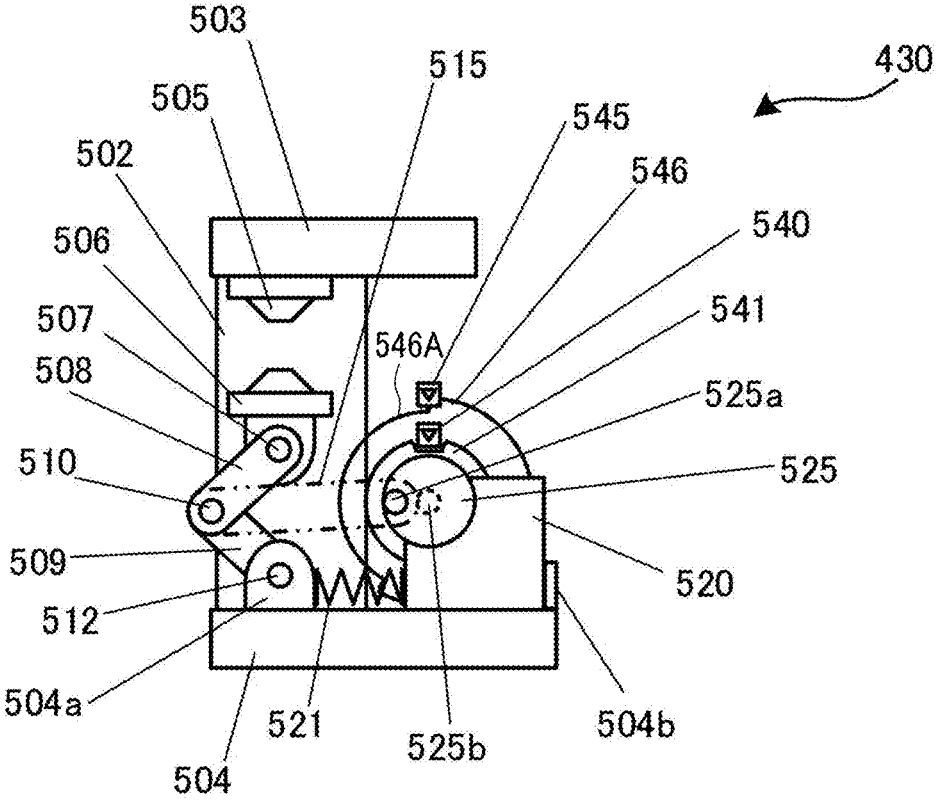
FIG. 27 is a front view of the stapleless binding unit illustrated in FIG. 26.
Figure 28:
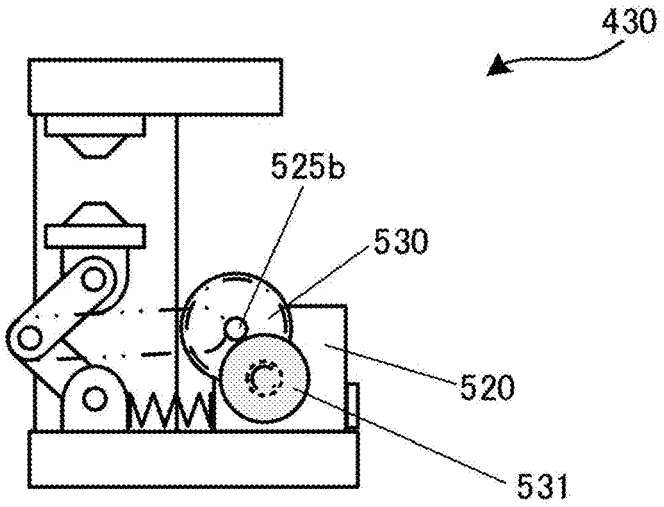
FIG. 28 is a front view illustrating a driver of the stapleless binding unit illustrated in FIG. 26.

In view of the foregoing, the configuration of the stapleless binding unit 430 is described with reference to FIGS. 26, 27, and 28. FIG. 26 is a side view of the stapleless binding unit 430, and FIG. 27 is a front view illustrating the internal configuration of the stapleless binding unit 430. FIG. 28 is a front view illustrating a configuration to drive a crank 525.

The housing of the stapleless binding unit 430 includes a front plate 501, a rear plate 502, an upper frame 503, and a lower frame 504. Of the pair of toothlike portions 505 and 506 (the pair of clamp members) for press-binding (stapleless stapling), the upper toothlike portion 505 is secured to the upper frame 503, and the lower toothlike portion 506 is coupled to a lower frame support **504*a* (illustrated in FIG. 27) via a movable shaft 507, an upper pressure link 508, a movable shaft 510, a lower pressure link 509, and a movable shaft 512. With such coupling, the lower toothlike portion 506 functions as a link mechanism that vertically expands and contracts. A connector 515 connects the movable shaft 510 to the crank 525 to enable the link mechanism to act, and the lower toothlike portion 506 moves up and down by the rotation of the crank 525. The crank 525 is a rotator that rotates in a specified direction to periodically bring the pair of pressing members (the upper toothlike portion 505 and the lower toothlike portion 506) into a separated state and a press-contact state. The rotation of the crank 525** in the specified direction is referred to as "forward rotation", and the rotation in the opposite direction to the specified direction is referred to as "reverse rotation". A description in detail of the forward rotation in the specified direction according to the present embodiment is deferred.

A pressing frame 520 supports a crank rotation shaft 525*b* of the crank 525, so that the crank 525 can rotate around the crank rotation shaft 525*b*. Further, as illustrated in FIG. 28, a drive gear 530 is fixed to one end of the crank rotation shaft 525*b* and obtains a drive force from a drive motor 531.

A home position shutter 541 and a crank position shutter 546 fixed to the other end of the crank rotation shaft 525*b* rotate in conjunction with the crank 525. A home position sensor 540 and a crank position sensor 545 are provided for the home position shutter 541 and a crank position shutter 546, respectively. The controller 400 (see FIG. 4) receives the detection signal from each sensor and controls the rotation of the drive motor 531 in accordance with the detection signal.

The crank position sensor 545 includes an irradiation unit that emits infrared (an example of a detection ray) and a light-receiving unit that receives the infrared. The crank position shutter 546 is a circular member that rotates in the same direction as the crank 525 and has steps on the outer periphery (see also FIG. 29). The steps divide the crank position shutter 546 into two parts of a high step section (a section with a long radius from the center of the circle) and a low step portion (a section with a short radius from the center of the circle, a specified range).

The irradiation unit and the light-receiving unit of the crank position sensor 545 face each other with the crank position shutter 546 interposed therebetween. When the high step section is between the irradiation unit and the light-receiving unit as the crank position shutter 546 rotates, the irradiation is blocked and the detection signal from the crank position sensor 545 is turned off. By contrast, when the low step section is between the irradiation unit and the light-receiving unit, the infrared passes through and reaches the light-receiving unit, and the detection signal from the crank position sensor 545 turns on. The home position shutter 541 and the home position sensor 540 have the same configurations.

The pressing frame 520 is slidable on the upper surface of the lower frame 504. A pressure spring 521 between the lower frame support 504*a* and the pressing frame 520 presses the pressing frame from the side of the lower frame support 504*a*. The range of movement of the pressing frame 520 is restricted by a stopper portion 504*b* opposite thereto.

A description is given of separation and pressing of the toothlike portions 505 and 506 of the stapleless binding unit 430 with reference to FIGS. 29A to 29F. As in the order of the state transition from FIGS. 29A to 29F, the crank 525 rotates clockwise when viewed in the direction illustrated in FIGS. 29A to 29F, which is the forward rotation of the crank 525.

Figures 29A, 29B, 29C, 29D, 29E, 29F:
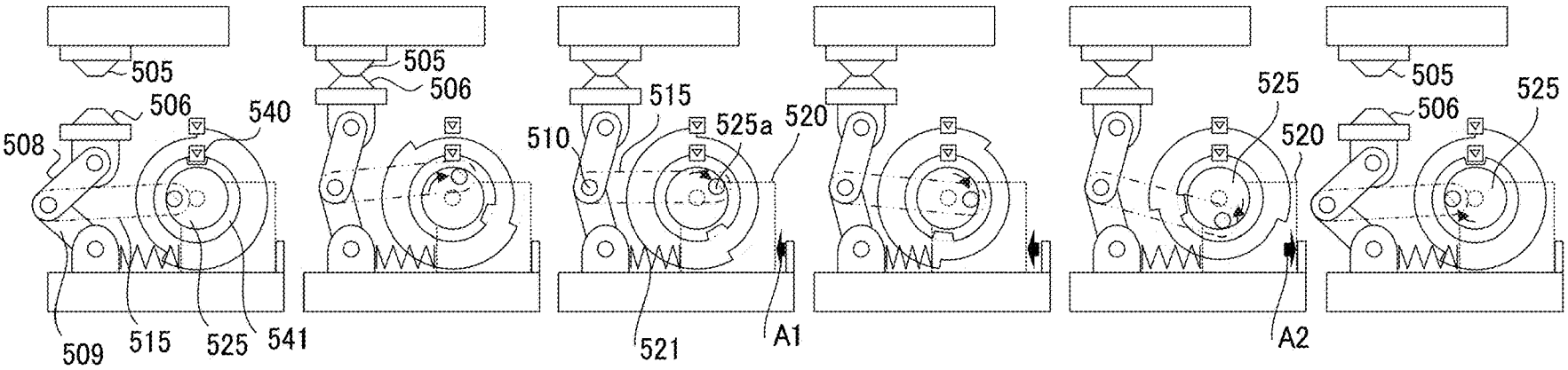
FIGS. 29A to 29F illustrate a state transition of the stapleless binding unit illustrated in FIG. 26.

FIG. 29A illustrates a state in which each part of the stapleless binding unit 430 is located at the home position, and the crank 525 is on standby in a range where the home position sensor 540 outputs an ON signal. In the state illustrated in FIG. 29A, the upper pressure link 508 and the lower pressure link 509 are folded downward. The positions of the upper pressure link 508 and the lower pressure link 509 are restricted by the connector 515. As a result, the lower toothlike portion 506 is also positioned at the lowest point. In the state illustrated in FIG. 29A, the distance between the upper toothlike portion 505 and the lower toothlike portion 506 is maximum, and the sheet bundle to be stapled by pressing can be received. In FIG. 29A, the crank 525 is at a first position that is the home position. At the first position, the pressing members are separated from each other. Although the distance between the pressing members is the maximum when the crank 525 is at the home position, the distance is not limited thereto. The distance is not necessarily the maximum as long as the pressing members are separated from each other.

FIG. 29B illustrates a state in which the crank 525 has rotated forward, and the upper toothlike portion 505 and the lower toothlike portion 506 start to contact each other. When the binding is to be performed, the sheet bundle is present between the upper toothlike portion 505 and the lower toothlike portion 506.

The transition from the state in FIG. 29A to the state illustrated in FIG. 29B is an approaching section. In the approaching section, the distance between the upper toothlike portion 505 and the lower toothlike portion 506 gradually decreases.

FIGS. 29C illustrates a state in which the crank 525 has further rotated forward from the state illustrated in FIG. 29B. Since the mechanism prevents the movable shaft 510 side of the connector 515 from moving, a connecting rod 525*a* is to be pulled toward the movable shaft 510. In conjunction with this movement, the pressing frame 520 including the crank 525 moves toward the movable shaft 510 (left side in the drawing) as indicated by arrow A1 in the drawing. Then, the pressure spring 521 is gradually contracted, and the pressing force thereof increases as the crank 525 further rotates. The pressing force urges the connector 515 to the right, and this spring force is transmitted to the upper pressure link 508 and the lower pressure link 509. This force is converted to force for further pressing the upper toothlike portion 505 and the lower toothlike portion 506 against each other. The pressing force is determined by the angle formed by the upper pressure link 508 and the lower pressure link 509, the spring force of the pressure spring 521, the direction (angle) in which the connector 515 pulls the movable shaft 510, and the like, The direction (angle) in which the connector 515 pulls the movable shaft 510 is determined by the positional relation between the crank 525 and the movable shaft 510 and the rotation direction. Generally, the positional relation is set to facilitate the forward rotation.

In the transition of state from FIG. 29B to FIG. 29C and to FIG. 29D, the pressing force increases. Further, in the state illustrated in FIG. 29D, the crank 525 is at the peak of the rotational position, and the pressing force is at the peak.

As the crank 525 is further rotated in the forward direction, the state transitions to the state illustrated in FIG. 29E. The pressing force at this time is smaller than that in the state illustrated in FIG. 29D, and the pressure spring 521 gradually expands. Along with this movement, the pressing frame 520 moves away from the movable shaft 510 (to the right side in the drawing) as indicated by arrow A2 in the drawing.

After that, as the crank 525 rotates, the upper toothlike portion 505 and the lower toothlike portion 506 move away from each other to the positions illustrated in FIG. 29F (home positions).

The above is a series of press-binding operations. The transition from the state illustrated in FIG. 29B to the state illustrated in FIG. 29E is a pressurization section. The section from the state illustrated in FIG. 29E to the state illustrated in FIG. 29F is a retreating section.

To prevent idle striking in the initial operation so as not to damage the upper toothlike portion 505 and the lower toothlike portion 506, the crank 525 is rotated in the reverse direction when the rotation angle of the crank 525 is upstream in the forward rotation from the position at which pressing is at the peak. Specifically, a second position of the crank 525 signifies a position downstream in the forward rotation direction from the above-mentioned first position and upstream by a predetermined angle from the peak position at which the pressing force between the pressing members (the upper toothlike portion 505 and the lower toothlike portion 506) is maximum. When the crank 525 is in a first range between the first position to the second position in the forward direction, the crank 525 is rotated in the reverse direction. This operation can return the crank 525 to the home position, without causing the idle striking, since the crank 525 does not pass the peak position. The predetermined angle is stored in a memory, for example, by a manufacturer based on empirical data.

However, the load on the drive system to rotate the crank 525 in the reverse direction is large compared with the rotation in the forward direction, which may cause an adverse effect, and the operation efficiency is degraded. Therefore, according to an aspect of the present disclosure, in order to reduce the load during the reverse rotation, the biasing force of the pressure spring 521 is also used.

To use the biasing force of the pressure spring 521, the binding apparatus 4 detects whether the crank 525 is in the first range from the home position as illustrated in FIG. 29A to the second position illustrated in FIG. 29C, in which the crank 525 is upstream from the peak position in the forward direction and the pressure spring 521 exerts the biasing force. Then, for the initial operation, in the case where the current rotational position of the crank 525 is in the first range from the position illustrated in FIG. 29A to the position illustrated in FIG. 29C, the crank 525 is rotated in the reverse direction and returned to the home position.

The crank position sensor 545 and the crank position shutter 546 are provided to detect that the crank 525 is in the first range from the position illustrated in FIG. 29A to the position illustrated in FIG. 29C. As described above, an aspect of the present embodiment is that the crank position sensor 545 is configured to switch the signal from ON to OFF at a timing at which the crank 525 is before the peak position in the pressurization section (the state illustrated in FIG. 29D).

The initial operation is started when the crank 525 is not driven and not at the home position. The purpose of the initial operation is to rotate the crank 525 to the home position. That is, the crank 525 under application of no driving force is rotated in the reverse direction by the biasing force of the pressure spring 521 and stopped at a position where no spring force is applied (between the position in FIG. 29B and the position in FIG. 29C). Such an operation can reduce the load in driving in the reverse rotation and reduce the load during the reverse rotation in which the operation efficiency is low.

Thus, the binding apparatus 4 controls, in the initial operation, stop, forward rotation, and reverse rotation of the crank 525 according to the detection signals from the home position sensor 540 and the crank position sensor 545. FIG. 30 is a table summarizing the relation between the detection signals of the sensors and the rotation direction of the crank 525. In FIG. 30, the column of "transition in FIGS. 29A to 29F" corresponds to FIGS. 29A to 29F.

As illustrated in FIG. 30, when the signal of the home position sensor 540 is ON, the crank 525 is at such an angle that the toothlike portions 505 and 506 are at the home positions (hereinafter referred to as the "initial angle"). Accordingly, the crank 525 is not to be rotated in forward direction (clockwise in the drawings) or reverse direction (counterclockwise in the drawings) but is stopped regardless of the detection signal from the crank position sensor 545.

When the signal from the home position sensor 540 is OFF and the signal from the crank position sensor 545 is ON, the crank 525 is upstream from the peak position in the forward direction. Accordingly, the crank 525 is rotated in the reverse direction (counterclockwise in the drawings) to the initial angle. When the home position sensor 540 is OFF and the crank position sensor 545 is OFF, the crank 525 is rotated forward (clockwise in the drawings) to the initial angle.

Figure 31:
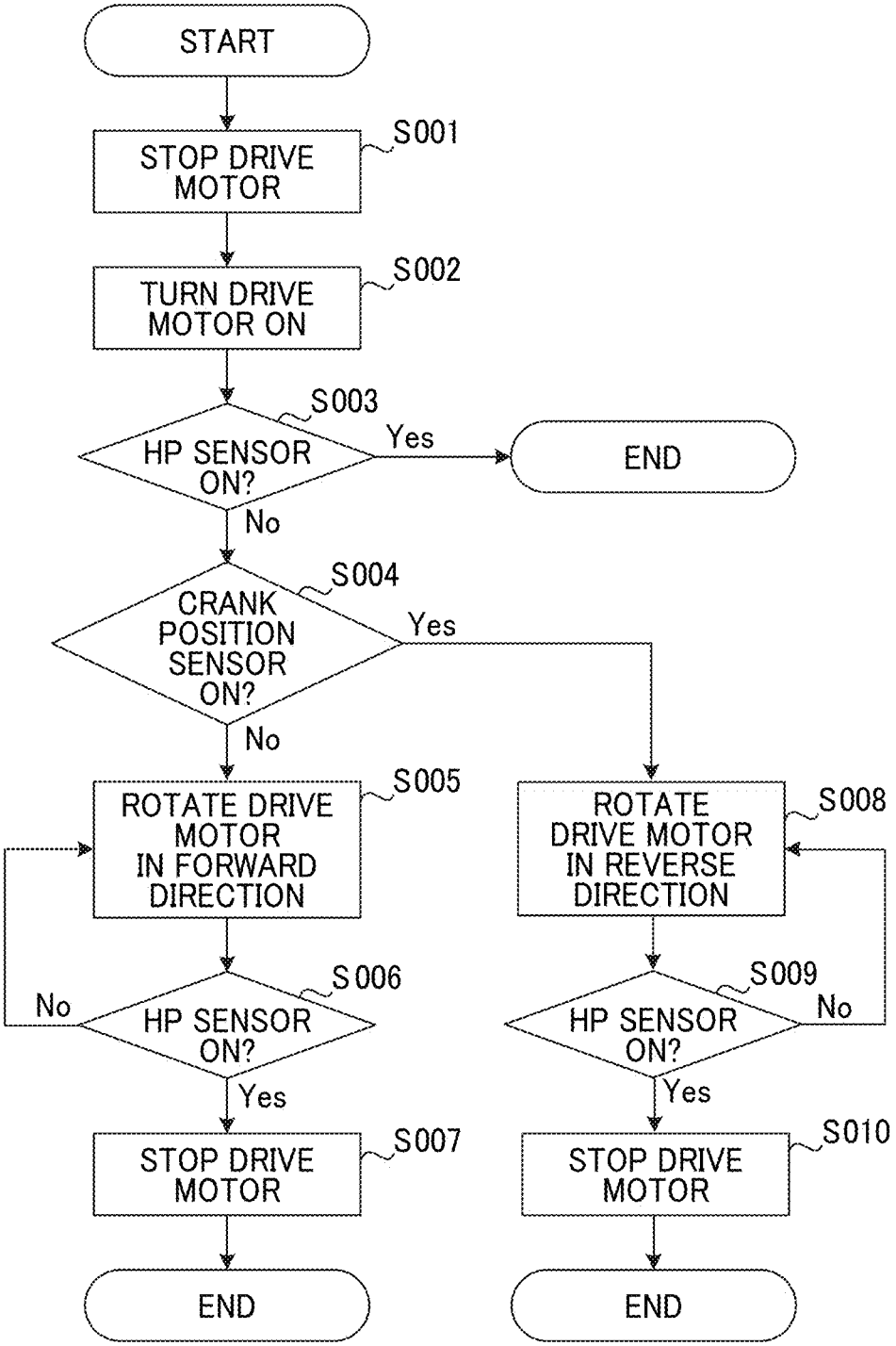
FIG. 31 is a flowchart illustrating control operation of the stapleless binding unit in FIGS. 29A to 29F.

FIG. 31 is a flowchart illustrating the control in the initial operation of the stapleless binding unit 430.

At the start of the initial operation, the controller 400 turns on the drive motor 531 after a predetermined time elapses from when the drive motor 531 turns off (S001 and S002). Then, the controller 400 determines whether or not the signal from the home position (HP) sensor 540 is the ON signal (S003). In response to the ON signal from the home position sensor 540 (Yes in S003), the crank 525 is at the initial angle, and thus the initial operation ends.

When the signal output from the home position sensor 540 is not the ON signal (No in S003), the controller 400 determines whether the signal output from the crank position sensor 545 is the ON signal (S004).

In response to the ON signal from the crank position sensor 545 (Yes in S004), the controller 400 causes the drive motor 531 to rotate the crank 525 in the reverse direction (S008). Then, the controller 400 keeps driving of the drive motor 531 until the ON signal is input from the home position sensor 540 (No in S009). In response to the ON signal from the home position sensor 540 (Yes in S009), the controller 400 determines that the crank 525 has reached the initial angle and stops the rotation of the drive motor 531 (S010). Then, the initial operation completes.

By contrast, in S004, when the signal from the crank position sensor 545 is not the ON signal (No in S004), the controller 400 causes the drive motor 531 to rotate the crank 525 in the forward direction (S005). Then, the controller 400 keeps driving the drive motor 531 until the ON signal is input from the home position sensor 540 (No in S006). In response to the ON signal from the home position sensor 540 (Yes in S006), the controller 400 determines that the crank 525 has reached the initial angle and stops the rotation of the drive motor 531 (S007). Then, the initial operation completes.

Figure 32:
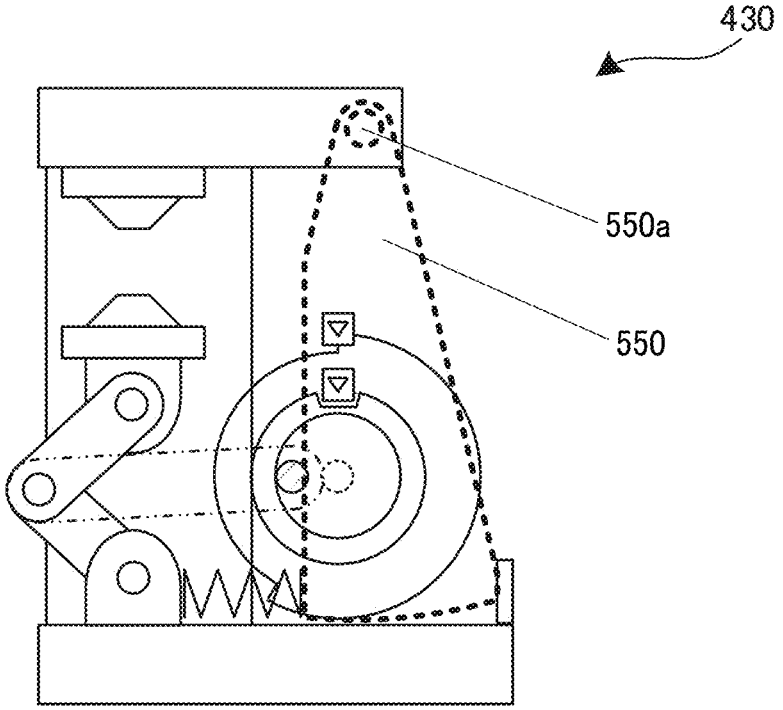
FIG. 32 illustrates a stapleless binding unit according to another embodiment.

In the description above, the pressing frame 520 slides on the upper surface of the lower frame 504. Alternatively, as illustrated in FIG. 32, a pressing frame 550 that swings around a pressing frame swing fulcrum 550*a* on the upper frame 503 may be used.

The crank position sensor 545 and the crank position shutter 546 (the circular member) construct a detector. In the above-described embodiment, the detector has been described as detecting whether or not the crank 525 is between the first position and the second position. As described above, the range from the first position to the second position in the forward rotation direction corresponds to the low step section on the periphery of the crank position shutter 546, and, in this range, the crank position sensor 545 outputs the ON signal to the controller 400. That is, the low step section serves as a stepped portion configured to indicate that the rotator is between the first position and the second position in the forward rotation direction.

The pressure spring 521 of the above-described embodiment serves as a biasing member. In the above embodiment, the pressure spring 521 is described as a member that biases the crank 525 so as to rotate in the reverse direction. The pressing frame 520 starts moving in the direction indicated by arrow A1 between the state in FIG. 29B to the state in FIG. 29C in FIG. 29, and the pressure spring 521 starts urging the crank 525 with this movement. That is, the pressure spring 521 starts urging the crank 525 when the crank 525 is located between the first position and the second position in the forward rotation direction.

As described above, an aspect of the present disclosure is to reduce the load on the toothlike portions and the pressurizing mechanism in moving the toothlike portions to the home positions during the initial operation of the binding apparatus.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A binding apparatus configured to bind a sheet bundle, the binding apparatus comprising:

a pair of pressing members configured to sandwich and press the sheet bundle to bind the sheet bundle;

a rotator configured to rotate to periodically cause the pair of pressing members to separate and contact with each other;

a detector configured to detect whether the rotator is between a first position at which the pair of pressing members is separated from each other and a second position downstream from the first position in a forward rotation direction of the rotator, the second position upstream in the forward rotation direction from a peak position at which a pressing force between the pair of pressing members is maximum; and control circuitry configured to rotate the rotator in a reverse direction to the forward rotation direction to move the rotator to the first position in response to a detection, by the detector, that the rotator is between the first position and the second position in the forward rotation direction.

2. The binding apparatus according to claim 1, wherein, in a state where the rotator is at the first position, a distance between the pair of pressing members is maximum.

3. The binding apparatus according to claim 1, further comprising a biasing member configured to bias the rotator in the reverse direction, the biasing member configured to start biasing the rotator when the rotator is between the first position and the second position in the forward rotation direction.

4. The binding apparatus according to claim 1, wherein the detector includes:

a circular member configured to rotate in conjunction with the rotator, the circular member including a stepped portion on a periphery of the circular member, the stepped portion configured to indicate that the rotator is between the first position and the second position in the forward rotation direction; and a sensor configured to irradiate, with a detection ray, the circular member and output a signal indicating that the rotator is between the first position and the second position in the forward rotation direction in accordance with the stepped portion of the circular member.

5. The binding apparatus according to claim 1, wherein the control circuitry is configured to rotate the rotator in the forward rotation direction in response to a detection, by the detector, that the rotator is between the second position and the first position in the forward rotation direction.

6. An image forming system comprising:

an image forming apparatus configured to form an image on a sheet, and the binding apparatus according to claim 1, configured to bind a plurality of sheets on which images are formed by the image forming apparatus.

* * * * *